US007448717B2

(12) United States Patent
Wanibe et al.

(10) Patent No.: US 7,448,717 B2
(45) Date of Patent: Nov. 11, 2008

(54) CONTAINER HAVING LIQUID DETECTING FUNCTION, AND SENSOR UNIT

(75) Inventors: Akihisa Wanibe, Nagano (JP); Minoru Yajima, Nagano (JP); Akira Ichihashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 448 days.

(21) Appl. No.: 11/395,875

(22) Filed: Mar. 30, 2006

(65) Prior Publication Data

US 2006/0251430 A1 Nov. 9, 2006

(30) Foreign Application Priority Data

Mar. 31, 2005 (JP) ..... P2005-103265
May 12, 2005 (JP) ..... P2005-140437
Dec. 28, 2005 (JP) ..... P2005-380293

(51) Int. Cl.
*B41J 29/393* (2006.01)
*B41J 2/175* (2006.01)

(52) U.S. Cl. ..... 347/19; 347/86

(58) Field of Classification Search ..... 347/7, 347/19, 86, 87
See application file for complete search history.

(56) References Cited

U.S. PATENT DOCUMENTS 6,536,861 B1 * 3/2003 Usui et al. ..... 347/7
6,547,452 B1 4/2003 Chan et al.
6,554,381 B2 * 4/2003 Locher et al. ..... 347/7
6,966,642 B2 * 11/2005 Hanaoka et al. ..... 347/86
6,994,415 B2 2/2006 Asauchi et al.
7,357,494 B2 * 4/2008 Katayama et al. ..... 347/86
2002/0135623 A1 9/2002 Tsukada et al.
2003/0201462 A1 10/2003 Pommer et al.

FOREIGN PATENT DOCUMENTS

| | | | |
|---|---|---|---|
| CN | 1274647 | A | 11/2000 |
| CN | 1478658 | A | 3/2004 |
| EP | 1 053 877 | A1 | 11/2000 |
| EP | 1 164 021 | A2 | 12/2001 |
| EP | 1 245 393 | A1 | 10/2002 |
| GB | 2 338 184 | A | 12/1999 |
| GB | 2 413 385 | A | 10/2005 |
| JP | 2000-056700 | A | 2/2000 |
| JP | 2001-146024 | A | 5/2001 |
| JP | 2001-146030 | A | 5/2001 |

OTHER PUBLICATIONS

Combined Search and Examination Report in GB 0606407.5 (Jul. 19, 2006).
International Search Report in PCT/JP2006/30729 (Jun. 29, 2006).

* cited by examiner

*Primary Examiner*—Anh T. N. Vo
(74) *Attorney, Agent, or Firm*—Stroock & Stroock & Lavan LLP

(57) ABSTRACT

A mis-assembly preventing structure is provided to a liquid container to allow assembly of parts when the parts are assembled in an adequate direction and to prevent the assembly of the parts when the part are assembled in an inadequate direction. For example the structure can be provided to a sensor unit (200) and a cartridge case (101), and can be constructed by engagement hooks (267) and engagement concave portions (110*k*) for receiving the engagement hooks (267).

14 Claims, 13 Drawing Sheets

250
250
253
253
253
253
252
252
216
216
216
216
218
211
a
b
a≠b
210
222
223
220
217,227

CONTAINER HAVING LIQUID DETECTING FUNCTION, AND SENSOR UNIT

BACKGROUND OF THE INVENTION

The present invention relates to a container having a liquid detecting function (more particularly, an ink residual quantity detecting function) adapted for a liquid ejection device (or a liquid consumption device) such as an inkjet recording device.

As a representative example of a conventional liquid ejection device, there is an inkjet recording device including an inkjet recording head for recording an image. As the other liquid ejection devices, there are, for example, a device including a color material ejection head used for manufacturing a color filer, such as a liquid crystal monitor, and a device including an electrode material (conductive paste) ejection head used for forming an electrode, such as an organic electroluminescence display or a field emission display (FED), a device including a living organic material ejection head used for manufacturing a bio chip, and a device including a sample ejection head as a precise pipette.

In the inkjet recording device which is the representative example of the liquid ejection device, a pressure generating means for, pressuring a pressure generating chamber and an inkjet recording head having a nozzle opening for ejecting pressurized ink as an ink droplet are mounted in a carriage, and the ink in an ink container is continuously fed to the recording head through a channel such that printing is continuously performed. The ink container is a detachable cartridge which can be simply replaced by a user when the ink is used up.

Conventionally, as a method of managing ink consumption of the ink cartridge, there are a method of integrating the quantity of ink sucked by the maintenance or the number of ink droplets ejected from the recording head using software to manage the ink consumption by calculation and a method of attaching an electrode for detecting a liquid level to the ink cartridge to manage a point of time when the ink is actually consumed by a predetermined quantity.

However, the method of integrating the quantity of the ink or the number of ejected ink droplets using the software to manage the ink consumption by calculation has the following problems. There may be a head in which ejected ink droplets have weight variations. The weight variations of the ink droplets do not have influence on image quality. However, in consideration of a case where error in the quantity of the consumed ink due to the variation is accumulated, an excess quantity of ink must be filed in the ink cartridge. Accordingly, the ink may remain by the excess.

On the other hand, since the method of managing the point of time when the ink is consumed by the electrode can detect the actual quantity of the ink, the residual quantity of the ink can be managed with high reliability. However, when the detection of the liquid level of the ink depends on the conductivity of the ink, the kind of the ink which can be detected is restricted or a structure for sealing for the electrode becomes complicate. In addition, since noble metal having excellent corrosion resistance and excellent conductivity is used as the material of the electrode, a cost for manufacturing the ink cartridge increases. Furthermore, since two electrodes need be mounted, the number of steps increases and thus the manufacturing cost more increases.

Accordingly, a device which is developed for solving the problems is disclosed in Patent document 1 as a piezoelectric device (here, referred to as sensor unit). The sensor unit monitors the residual quantity of the ink in the ink cartridge using a change in a resonance frequency of a residual oscillation signal due to residual oscillation (free oscillation) of a diaphragm after forcible oscillation, when the ink exist or not in the cavity facing the diaphragm in which a piezoelectric element is laminated.

Patent Document 1: Japanese Unexamined Patent Application Publication No. 2001-146030.

However, when the sensor unit disclosed in Patent Document 1 is used, the ink must enter up to the cavity facing the diaphragm and be prevented from entering into a side in which the piezoelectric element of an electrical element is provided. Accordingly, adjacent members must be properly sealed when they are assembled.

As a sealing structure, there is provided a structure in which the sensor unit is directly bonded to the periphery of an opening of the container or a structure in which the sensor unit is directly bonded to the periphery of an opening of a module and the module is then attached to a container body through an O-ring. However, in these structures, since the sensor unit is in contact with the periphery of the opening, it is difficult to ensure a sealing property when dimensional variation is generated. In addition, when the sensor unit is directly bonded to the periphery of the opening of the container or the periphery of the opening of the module, the sensor unit is apt to be influenced by fluctuation of ink or air bubble in the ink and thus false detection may be caused.

Furthermore, when this kind of the sensor is completed, a plurality of parts must be adequately assembled. However, when an assembling direction is wrong, yield deteriorates.

SUMMARY OF THE INVENTION

An object of the present invention is to provide a container having a liquid detecting function, which is hardly influenced by dimensional precision of parts.

Another object of the present invention is capable of simply and surely performing sealing when a sensor unit is attached to a container body.

Yet another object of the present invention is to provide a container having a liquid detecting function, which is hardly influenced by fluctuation of ink, or air bubble in the ink.

Still another object of the present invention is to provide a container having a liquid detecting function, which eases assembly to improve yield and productivity.

The present invention provides, as illustrative, non limiting embodiments, the following arrangements:

(1) A container comprises a container body accumulating liquid therein and having a delivering passage for delivering the liquid to an outside of the container body; a sensor receiving portion provided in the container body in the vicinity of an end of the delivering passage; a sensor unit, which is mounted in the sensor receiving portion, for detecting the liquid; buffer chambers which are provided in the container body, situate close to the sensor receiving portion through a sensor receiving wall, communicate with an upstream side and a downstream side of the delivering passage, and are disposed in the delivering passage in series; a sealing member which seals the sensor unit and the sensor receiving wall and has elasticity; and a pressing spring which presses the sensor unit against the sensor receiving wall to apply a pressing force required for sealing the sensor unit and the sensor receiving wall to the sealing member, while deforming the sealing member. The sensor unit comprises: a sensor chip which has a sensor cavity for receiving the liquid to be detected, a lower surface of the sensor cavity being opened to receive the liquid and an upper surface thereof being closed by a diaphragm, and a piezoelectric element being provided on an upper surface of the diaphragm; a sensor base which is made of metal and on which the sensor chip is mounted and fixed; a unit base having an upper surface and a lower surface, the upper surface having a recess in which the sensor base is mounted, and the lower surface of the unit base facing the sensor receiving wall when the sensor unit is mounted in the sensor receiving portion; a pressing cover which is mounted and fixed on the unit base to cover the sensor chip, receives the pressing force of the pressing spring, and delivers the pressing force to the unit base; and a pair of terminal plates which is mounted and fixed on the unit base and electrically connected to a pair of electrodes of the sensor chip. A liquid reserving space communicating with the sensor cavity is formed in the unit base. A channel which connects the liquid reserving space with the buffer chambers is provided in the sensor receiving wall. A mis-assembly preventing structure which allows assembly when parts are assembled in an adequate direction and prevents the assembly by interference between the parts when the parts are assembled in an inadequate direction are provided to at least a set of parts among sets of the sensor unit and the container body, the sensor base and the unit base, the unit base and the terminal plates, and the unit base and the pressing cover.

(2) In the container according to (1), the mis-assembly preventing structure is provided to the sensor unit and the container body. The mis-assembly preventing structure allows insertion when the sensor unit is inserted into the sensor receiving portion of the container body in an adequate direction and prevents the insertion when the sensor unit is inserted into the sensor receiving portion of the container body in an inadequate direction.

(3). In the container according to (2), the mis-assembly preventing structure includes: engagement hooks which are protruded from insertion direction side surfaces of the sensor unit to be inserted into the sensor receiving portion, advance into a rear side of the sensor receiving portion while outwardly deforming side walls of the sensor receiving portion by inclined walls when the sensor unit is inserted into the sensor receiving portion in the adequate direction, and prevent the insertion of the sensor unit by collision of edge walls at the opposite side of the inclined walls with a periphery of an inlet of the sensor receiving portion when the sensor unit is inserted into the sensor receiving portion in the inadequate direction; and engagement concave portions which are provided at the side walls of the sensor receiving portion and receive the engagement hooks while excessive interference is avoid when the sensor unit is inserted up to a predetermined location of the sensor receiving portion in the adequate direction.

(4) In the container according to (3), the engagement hooks are protruded from side surfaces of the pressing cover or the unit base.

(5) In the container according to any one of (1) to (4), wherein the mis-assembly preventing structure is provided to the sensor base and the unit base. The mis-assembly preventing structure allows insertion when the sensor base is inserted into the recess of the upper surface of the unit base in the adequate direction and prevents the insertion by interference between the sensor base and the unit base when the sensor base is inserted into the recess of the upper surface of the unit base in the inadequate direction.

(6) In the container according to (5), the mis-assembly preventing structure includes: a positioning convex portion which is protruded from a periphery of the sensor base, and prevents the sensor base from being inserted into the recess by the interference with a periphery of the recess of the unit base when the sensor base is inserted into the recess of the upper surface of the unit base in the inadequate direction; and a positioning concave portion which is provided at the periphery of the recess of the unit base and receives the positioning convex portion when the sensor base is inserted into the recess of the upper surface of the unit base in the adequate direction.

(7) In the container according to any one of (1) to (6), the mis-assembly preventing structure is provided to the unit base and the terminal plates. The mis-assembly preventing structure allows assembly when the terminal plates are assembled on the unit base in the adequate direction and prevents the assembly by interference between the terminal plates and the unit base when the terminal plates are assembled on the unit base in the inadequate direction.

(8) In the container according to (7), the terminal plates have a same shape and each of the terminal plates has two mounting holes. Four support pins which are inserted into the mounting holes of the terminal plates are protruded at virtual rectangular vertexes on the unit base. An interval between the support pins which are vertically arranged at the virtual rectangular vertexes is equal to an interval between two mounting holes of each of the terminal plates and an interval between the support pins which are horizontally arranged is different from the interval between the two mounting holes of each of the terminal plates. The mis-assembly preventing structure is configured by the support pins having different intervals in a vertical and horizontal direction and the mounting holes of the terminal plates.

(9) In the container according to any one of (1) to (8), the mis-assembly preventing structure is provided to the unit base and the pressing cover. The mis-assembly preventing structure allows assembly when the pressing cover is assembled on the unit base in the adequate direction and prevents the assembly by the interference between the pressing cover and the unit base when the pressing cover is assembled on the unit base in the inadequate direction.

(10) In the container according to (9), the mis-assembly preventing structure includes: a positioning protrusion which is protruded from a lower surface of the pressing cover, and prevents the pressing cover from being assembled on the upper surface of the unit base by the interference with a periphery of the recess of the unit base when the pressing cover is assembled in the upper surface of the unit base in the inadequate direction; and a positioning concave portion which is provided at the periphery of the recess of the unit base and receives the positioning protrusion when the pressing cover is assembled on the upper surface of the unit base in the adequate direction.

(11) A container comprises: a container body accumulating liquid therein and having a delivering passage for delivering the liquid to an outside of the container body; a sensor receiving portion provided in the container body; a sensor unit, which is mounted in the sensor receiving portion, for detecting the liquid existing in a part of the delivering passage; engagement hooks which are protruded from the sensor unit in opposite directions and which includes: edge walls which collide with a periphery of an inlet of the sensor receiving portion to prevent insertion of the sensor unit when the sensor unit is inserted into the sensor receiving portion in an inadequate direction; and inclined walls which induce elastic deformation to enable the insertion of the sensor unit when the sensor unit is inserted into the sensor receiving portion in an adequate direction, and engagement concave portions which receive the engagement hooks when the sensor unit is inserted up to a predetermined location of the sensor receiving portion in the adequate direction.

(12) A sensor unit comprises: a sensor chip which has a sensor cavity for receiving liquid to be detected, a lower surface of the sensor cavity being opened to receive the liquid and an upper surface thereof being closed by a diaphragm, and a piezoelectric element being provided on an upper surface of the diaphragm; a sensor base on which the sensor chip is mounted and fixed; a unit base having an upper surface and a lower surface, the upper surface having a recess in which the sensor base is mounted; a pressing cover which is mounted and fixed on the unit base to cover the sensor chip; a pair of terminal plates which is mounted and fixed on the unit base and electrically connected to a pair of electrodes of the sensor chip; a positioning convex portion which is protruded from a periphery of the sensor base, and prevents the sensor base from being inserted into the recess by the interference with a periphery of the recess of the unit base when the sensor base is inserted into the recess of the upper surface of the unit base in an inadequate direction; and a positioning concave portion which is provided at the periphery of the recess of the unit base and receives the positioning convex portion when the sensor base is inserted into the recess of the upper surface of the unit base in an adequate direction.

(13) A sensor unit comprises: a sensor chip which has a sensor cavity for receiving liquid to be detected, a lower surface of the sensor cavity being opened to receive the liquid and an upper surface thereof being closed by a diaphragm, and a piezoelectric element being provided on an upper surface of the diaphragm; a sensor base on which the sensor chip is mounted and fixed; a unit base having an upper surface and a lower surface, the sensor base being mounted on the upper surface; a pressing cover which is mounted and fixed on the unit base to cover the sensor chip; a pair of terminal plates which is mounted and fixed on the unit base and electrically connected to a pair of electrodes of the sensor chip; two mounting holes formed in each of the terminal plates, an interval between the two mounting holes of one of the terminal plates being equal to an interval between the two mounting holes of the other of the terminal plate; four support pins which are protruded at virtual rectangular vertexes on the unit base, and inserted into the mounting holes of the terminal plates. An interval between the support pins which are vertically arranged at the virtual rectangular vertexes is equal to the interval between the two mounting holes of each of the terminal plates and an interval between the support pins which are horizontally arranged is different from the interval between the two mounting holes of each of the terminal plates.

(14) A sensor unit comprises: a sensor chip which has a sensor cavity for receiving liquid to be detected, a lower surface of the sensor cavity being opened to receive the liquid and an upper surface thereof being closed by a diaphragm, and a piezoelectric element being provided on an upper surface of the diaphragm; a sensor base on which the sensor chip is mounted and fixed; a unit base having an upper surface and a lower surface, the upper surface having a recess in which the sensor base is mounted; a pressing cover which is mounted and fixed on the unit base to cover the sensor chip; a pair of terminal plates which is mounted and fixed on the unit base and electrically connected to a pair of electrodes of the sensor chip; a positioning protrusion which is protruded from a lower surface of the pressing cover, and prevents the pressing cover from being assembled on the upper surface of the unit base by interference with a periphery of the recess of the unit base when the pressing cover is assembled in the upper surface of the unit base in an inadequate direction; and a positioning concave portion which is provided at the periphery of the recess of the unit base and receives the positioning protrusion when the pressing cover is assembled on the upper surface of the unit base in an adequate direction.

Advantages of the above-noted arrangements are, for example, as follows:

Since the sealing member (preferably, an annular sealing member) having elasticity is interposed between the sensor unit and the sensor receiving wall and the sensor unit is pressed against the sensor receiving portion by the pressing spring such that the sensor unit and the sensor receiving wall are sealed while deforming the sealing member, it is possible to more facilitate assembly when the sensor unit is previously assembled and the sensor unit is mounted in the container body later, compared with a case of using an adhesive. In addition, since the dimensional variation between parts can be absorbed by the elasticity of the sealing member, it is possible to surely perform sealing by simple assembly. Furthermore, since the liquid reserving space sealed by the sealing member is formed at the front side (the opened side) of the sensor cavity, the sensor unit is not influenced by the fluctuation of the ink or the air bubble in the ink.

Moreover, when the pressing cover for protecting the sensor chip is provided at the upper side of the sensor chip and the load of the pressing spring acts on the unit base through the pressing cover, it is possible to easily obtain necessary sealing performance and oscillation performance without affecting the sensor chip.

In addition, since the mis-assembly preventing structure is provided to at least a set among sets of the sensor unit and the container body, the sensor base and the unit base, the unit base and the terminal plate, and the unit base and the pressing cover, it is possible to properly assemble the parts and to improve assembly complication. Thus, it is possible to improve yield and productivity.

Moreover, when the sensor unit is inserted into the sensor receiving portion in the inadequate direction, the edge walls of the engagement hooks collides with the periphery of the inlet of the sensor receiving portion such that the sensor unit is prevented from being inserted. When the sensor unit is inserted into the sensor receiving portion in the adequate direction, the engagement hooks advance into the rear side of the sensor receiving portion while the outwardly deforming the both side walls of the sensor concave portion by inclined walls such that the sensor unit can be inserted (the engagement hooks themselves may be elastically deformed by the inclined walls to enable the insertion of the sensor unit into the sensor receiving portion). In addition, when the sensor unit is inserted up to the predetermined location of the sensor receiving portion in the adequate direction, the engagement hooks are received in the engagement concave portions. When the engagement hooks are received in the engagement concave portions, it is preferable to avoid the excessive interference between the engagement hooks and the engagement concave portions. Accordingly, it is possible to previously prevent the sensor unit from being wrongly inserted into the sensor receiving portion in a 180° reverse direction.

In this case, since the engagement hooks are provided at the both sides of the sensor unit and the engagement concave portions are provided at the both side walls of the sensor receiving portion, when a liquid accumulating space of the container body exists at the opposite side of the rear wall of the sensor receiving portion, it is possible to perform the mis-assembly preventing function without reducing the liquid accumulating space, that is, without affecting the liquid accumulating space.

In addition when the assembly is adequately completed, the engagement concave portions are engaged with the engagement hooks while the excessive interference is avoid, and thus the engagement does not affects the oscillation characteristics of the sensor unit and the deformation state of the sealing member due to the pressing spring.

Furthermore, since the engagement hooks are protruded from the both side surfaces of the pressing cover or the unit base, it is possible to prevent the mis-assembly, without affecting the sensor chip.

Moreover, when the sensor base is inserted into the recess of the unit base in the inadequate direction, the positioning convex portion interferes with the periphery of the recess of the unit base such that the sensor base is prevented from being inserted. In addition, when the sensor base is inserted into the recess of the unit base in the adequate direction, the positioning convex portion is received in the positioning concave portion such that the sensor base can be inserted. Accordingly, the sensor base is not fixed in the unit base in a wrong direction.

Moreover, the terminal plates are positioned by inserting two support pins of the unit base into two mounting holes. Here, when the intervals between adjacent two support pins among the four support pins are the same in both a vertical direction and a horizontal direction, the terminal plate may assembled on the unit base in an improper orientation (n the adequate direction) in which the terminal plate is rotated by 90°. In contrast, since the interval between the vertically adjacent support pins and the interval between the horizontally adjacent support pins are different from each other and only the interval between the vertically adjacent support pins is equal to the interval between the mounting holes of the terminal plate, only the two support pins which are vertically arranged can be inserted into the two mounting holes of the terminal plate. In other words, the terminal plate can be attached to the support pins which are vertically arranged, but cannot be attached to the support pins which are horizontally arranged. Accordingly, it is possible to prevent error in the mounting direction.

Furthermore, when the pressing cover is assembled on the upper surface of the unit base in the inadequate direction, the positioning protrusion interferes with the periphery of the recess of the unit base such that the pressing cover is prevented from being assembled. In addition, when the pressing cover is assembled in the upper surface of the unit base in the adequate direction, the positioning protrusion is received in the positioning concave portion such that the pressing cover can be assembled. Accordingly, the pressing cover is not assembled in the unit base in a wrong direction.

The above-noted advantages and other advantages will be discussed in more detail with reference to illustrative, non-limiting embodiments shown in the accompanying drawings.

The present disclosure relates to the subject matter contained in Japanese patent application Nos. 2005-103265 (filed on Mar. 31, 2005), 2005-140437 (filed on May 12, 2005), 2005-380293 (filed on Dec. 28, 2005), each of which is expressly incorporated herein by reference in its entirety.

BRIEF DESCRIPTION OF THE DRAWINGS

FIGS. 10A and 10B are views used for explaining a relationship between dimensions of main parts of the sensor unit, wherein FIG. 10A is a plan view of a terminal plate, and FIG. 10B is a plan view of a unit base and a sensor base.

DESCRIPTION OF THE PREFERRED EMBODIMENT

Hereinafter, an ink cartridge (liquid container) having a liquid detecting function according to an embodiment of the invention will be described with reference to the accompanying drawings.

Figure 1:
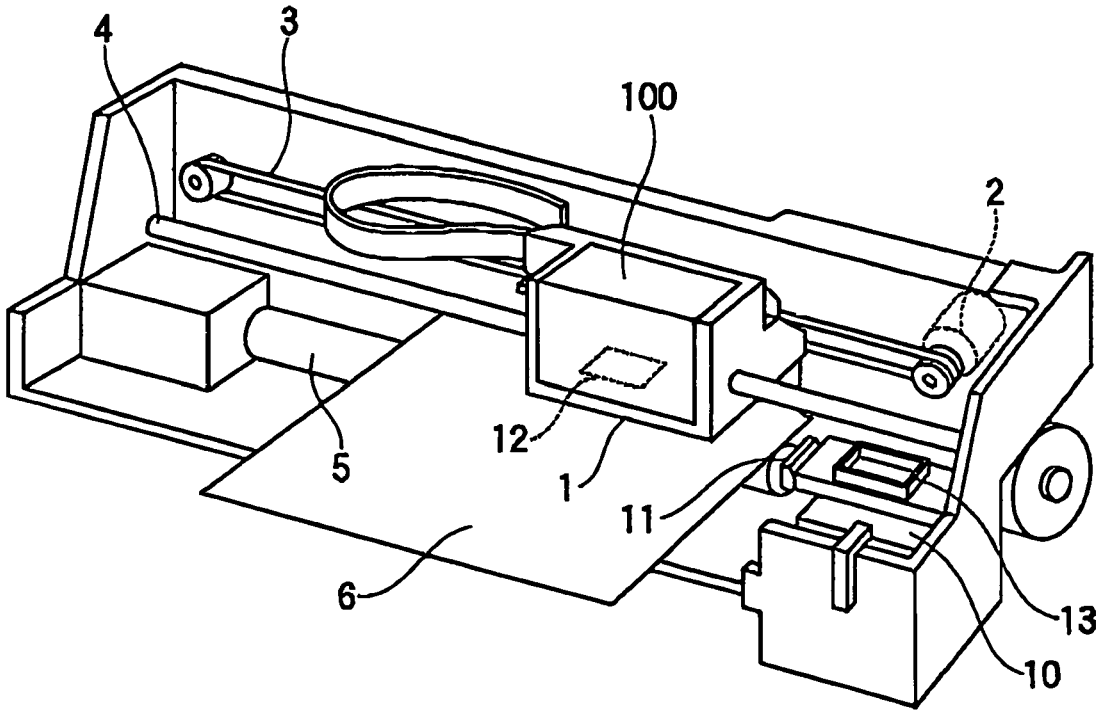
FIG. 1 is a perspective view showing a schematic configuration of an inkjet recording device (liquid ejection device) using an ink cartridge (container) according to an embodiment of the present invention.

FIG. 1 shows a schematic configuration of an inkjet recording device (liquid ejection device) using an ink cartridge according to an embodiment of the present invention. In FIG. 1, reference numeral 1 denotes a carriage. The carriage 1 is guided by a guided member 4 and driven by a carriage motor 2 through a timing belt 3 to be reciprocally moved in an axial direction of a platen 5.

An inkjet recording head 12 is mounted on the carriage 1 to face a recoding sheet 6, and an ink cartridge 100 for feeding ink to the recording head 12 is detachably mounted on the inkjet recording head 12.

A cap member 13 is disposed at a home position (a right side of the drawing) which is a non-print region of the recoding device). The cap member 13 is pressed by a nozzle forming surface of the recording head 12 when the recoding head 12 mounted on the carriage 1 is moved to the home position to form an enclosed space with the nozzle forming surface. In addition, a pump unit 10 for applying a negative pressure to the enclosed space formed by the cap member 13 to perform cleaning is disposed below the cap member 13.

Furthermore, a wiping means 11 including an elastic plate such as rubber is disposed in the vicinity of a print region of the cap member 13 and advances or retreats, for example, in a horizontal direction of a movement locus, such that, if necessary, the nozzle forming surface of the recording head 12 is cleaned when the carriage 1 is reciprocally moved to the cap member 13.

Figure 2:
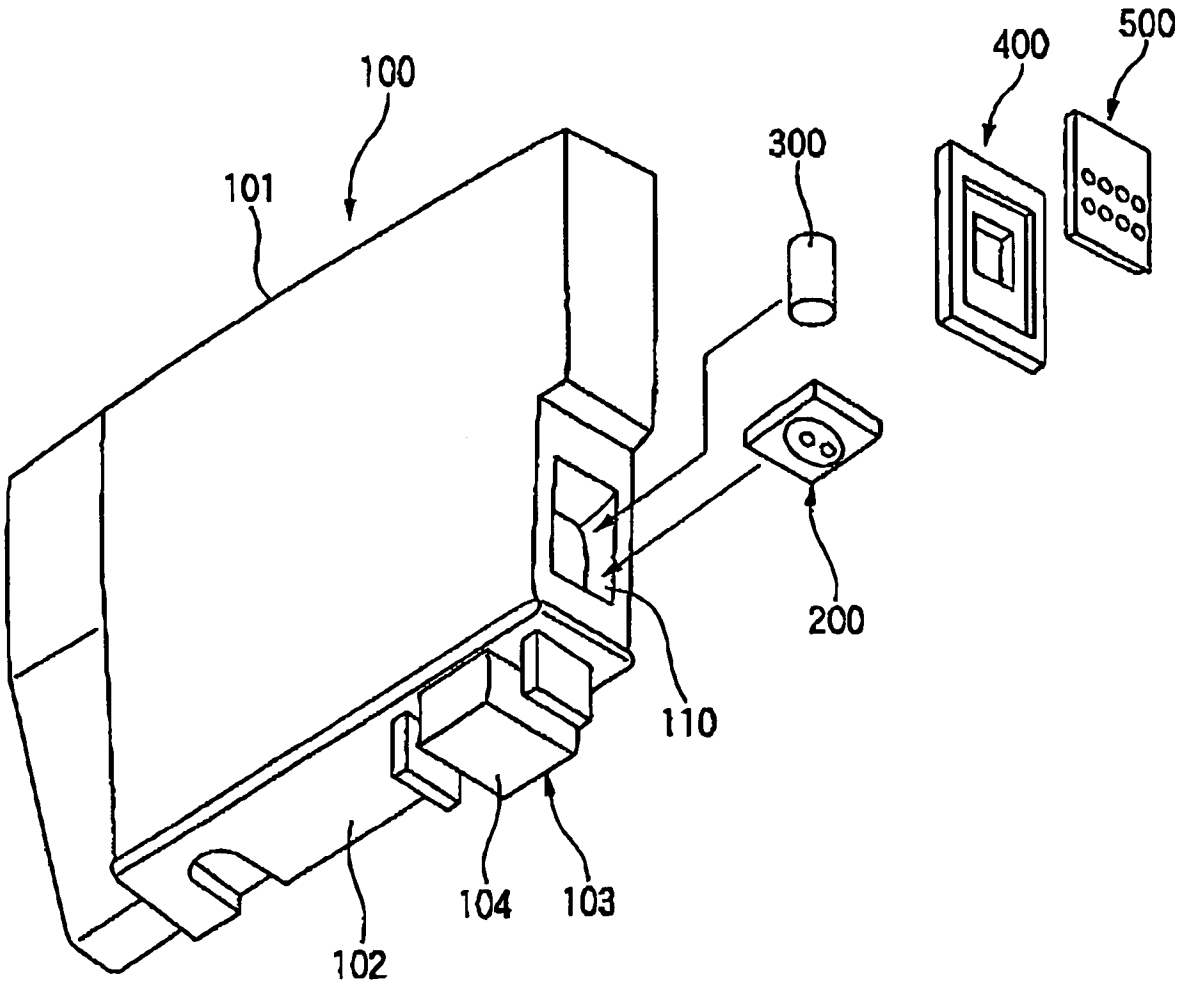
FIG. 2 is an exploded perspective view showing a schematic configuration of the ink cartridge according the embodiment of the present invention.

FIG. 2 is a perspective view showing a schematic configuration of the ink cartridge 100. In the ink cartridge 100, a sensor unit 200 which is a main element for performing the liquid detecting function is received.

The ink cartridge 100 has a cartridge case (container body) 101 made of resin and including an ink accumulating portion (not shown), and a cover 102 made of resin and mounted to the cartridge case 101 to cover a lower end surface of the cartridge case 101. The cover 102 protects various kinds of sealing films attached to the lower end surface of the cartridge case 101. An ink delivering portion 103 is protruded from the lower end surface of the cartridge case 101 and a cover film 104 for protecting an ink delivering port (liquid outlet port, not shown) is attached to the lower end surface of the ink delivering potion 103.

In addition, a sensor receiving concave portion (sensor receiving portion) 110 for receiving the sensor unit 200 is provided in a narrow side surface of the cartridge case 101, and the sensor unit 200 and a compression coil spring (pressing spring) 300 are received in the sensor receiving concave portion 110.

The compression coil spring (hereinafter, referred to as spring) 300 ensures a sealing property between the sensor unit 200 and the cartridge case 101 by pressing the sensor unit 200 to a sensor receiving wall 120 (see FIGS. 7 and 8) of an inner bottom of the sensor receiving concave portion 110 to deform a sealing ring 270.

The sensor receiving concave portion 110 is opened at the narrow side surface of the cartridge case 101 so that the sensor unit 200 and the spring 300 are inserted through an opening provided at the side surface. Furthermore, the opening of the sensor receiving concave portion 110 at the side surface is closed by a sealing cover 400 on which a board 500 is attached at the outside thereof.

Figure 3:
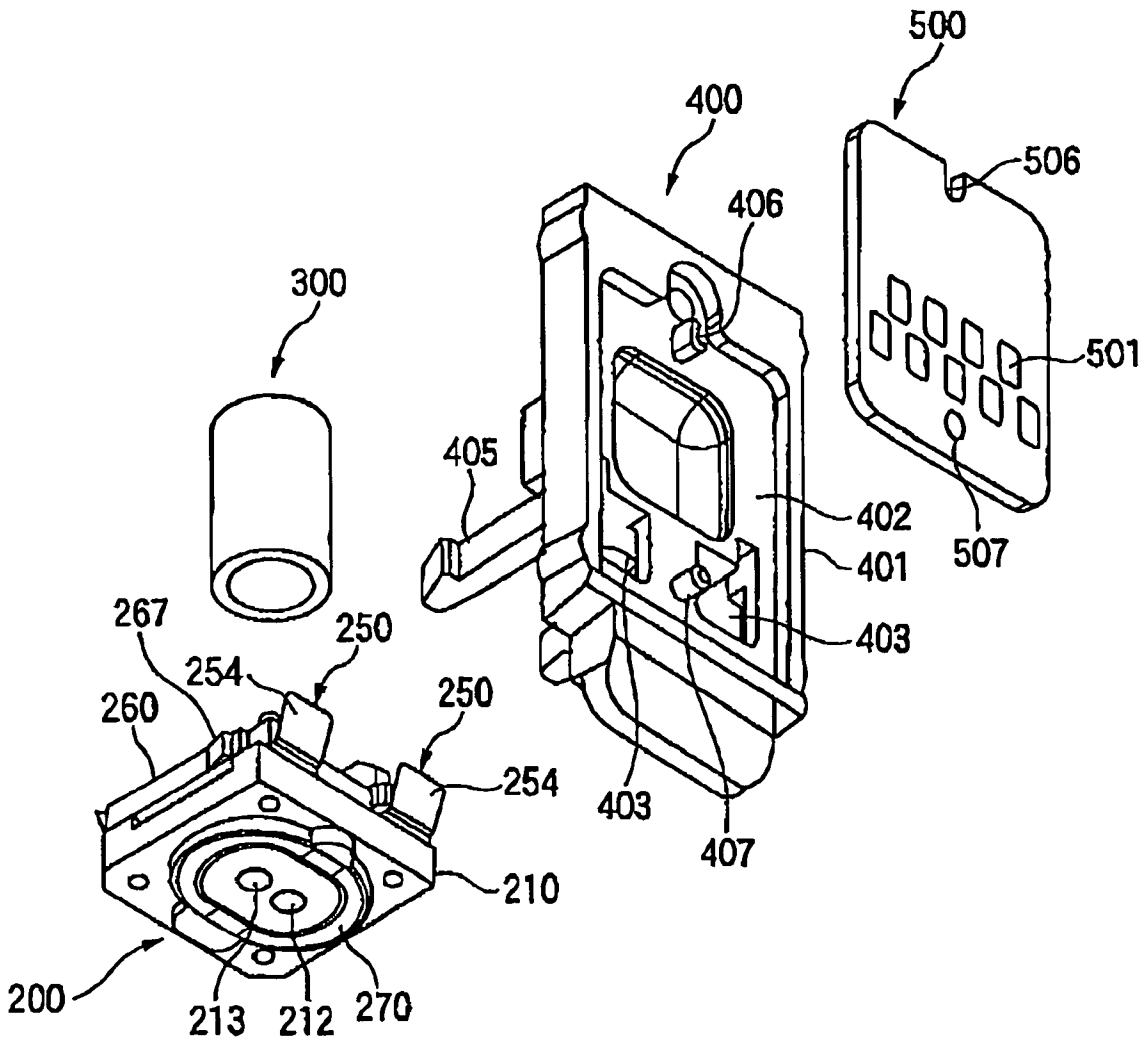
FIG. 3 is an exploded perspective view showing configurations of a sensor unit, a spring, a sealing cover, and a circuit board in the ink cartridge according to the embodiment of the present invention.
Figure 4:
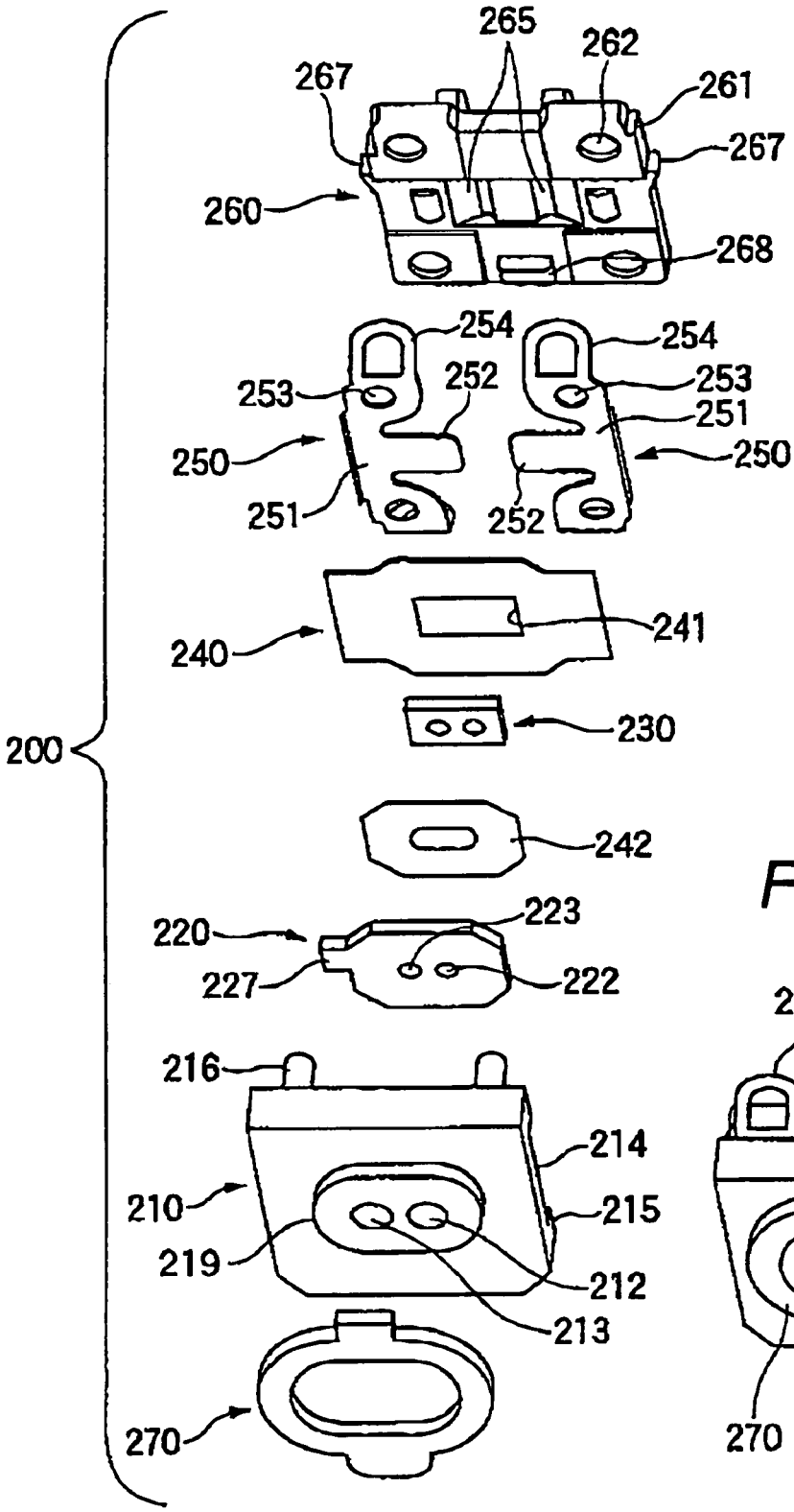
FIG. 4 is an exploded perspective view of the sensor unit in the ink cartridge.
Figure 4:
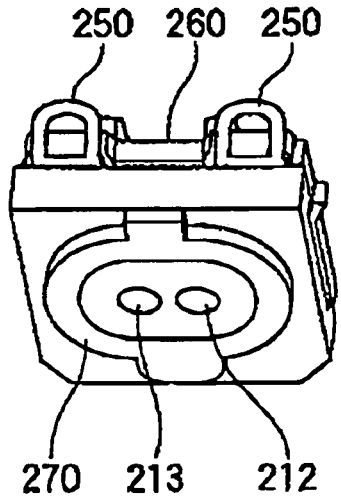
Figure 5:
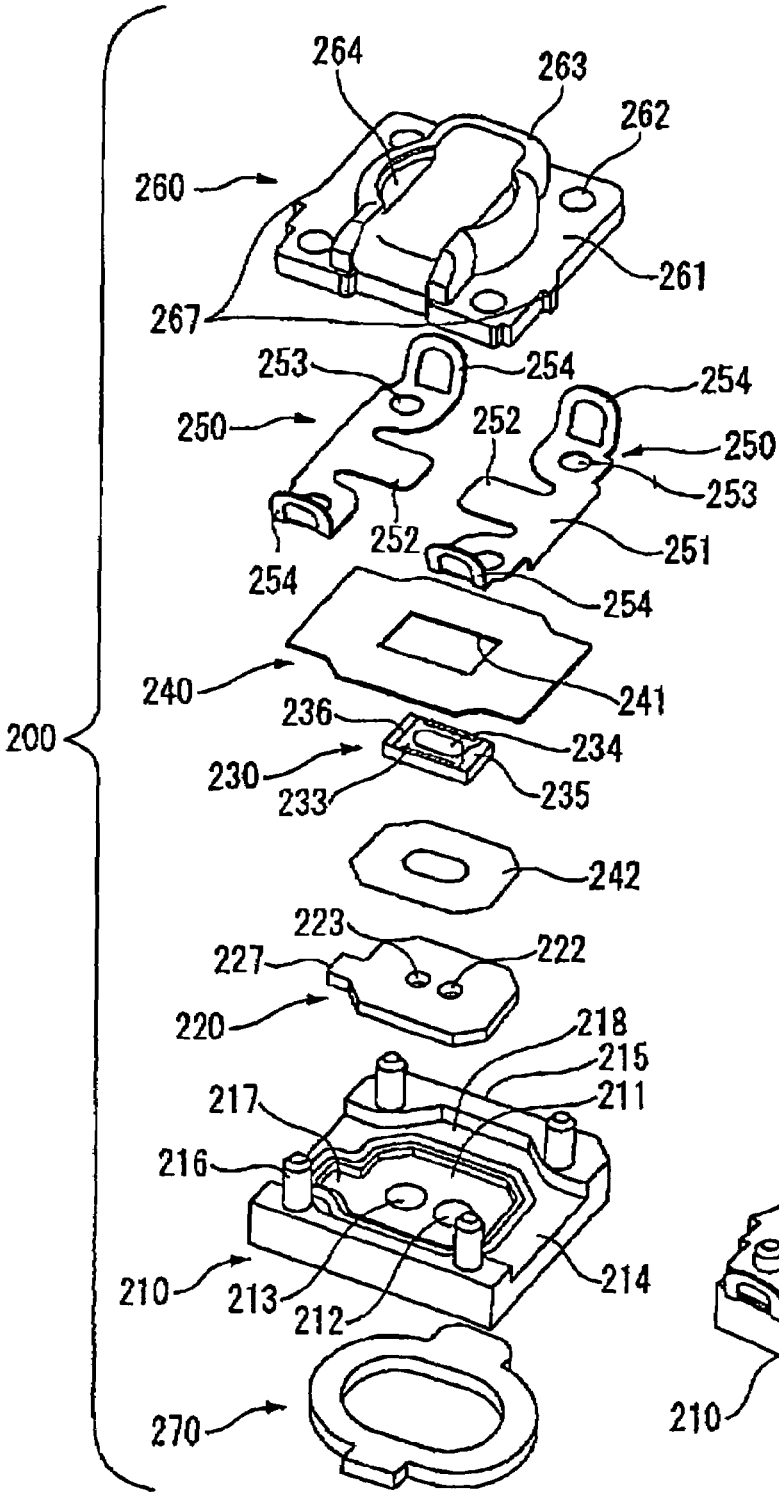
FIG. 5 is an exploded perspective view of the sensor unit when viewed at an angle different from that of FIG. 4.
Figure 5:
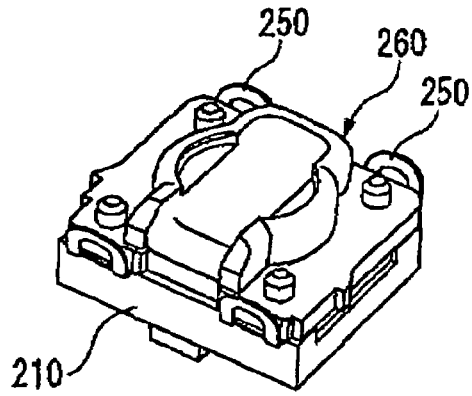
Figure 6:
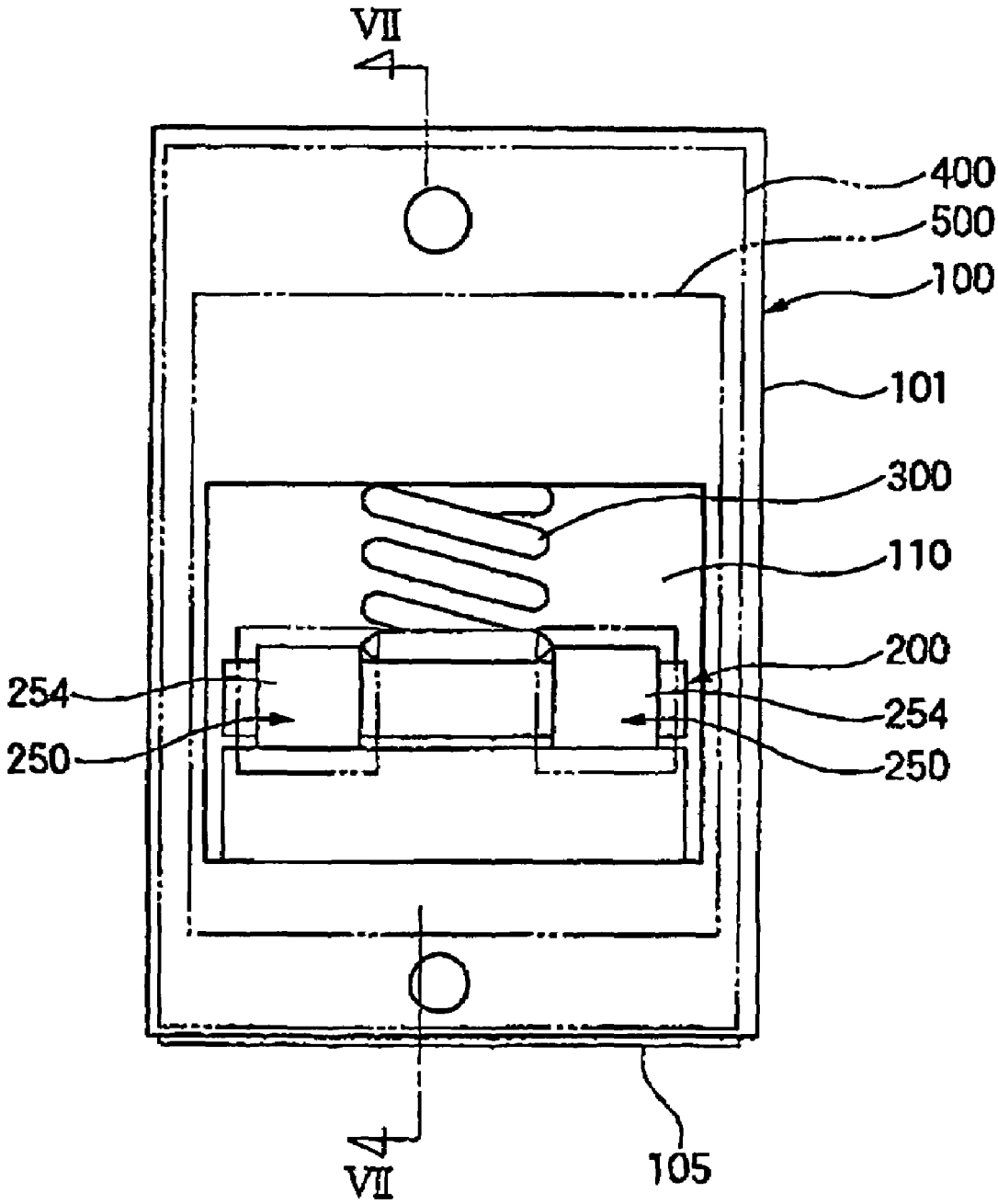
FIG. 6 is a front view of a portion in which the sensor unit and the spring are assembled into a sensor receiving concave portion.
Figure 9:
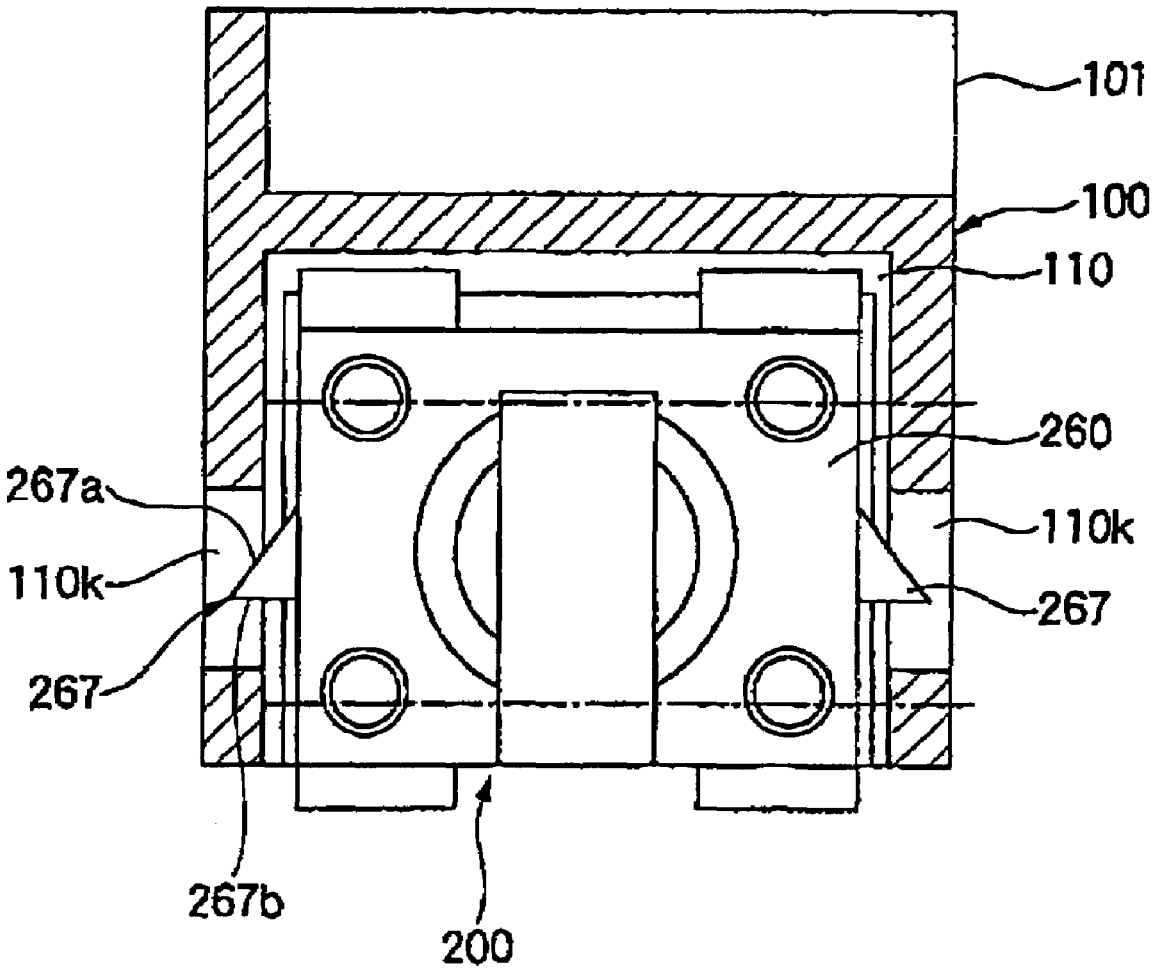
FIG. 9 is a horizontal cross-sectional view of that shown in FIG. 8.
Figure 10:
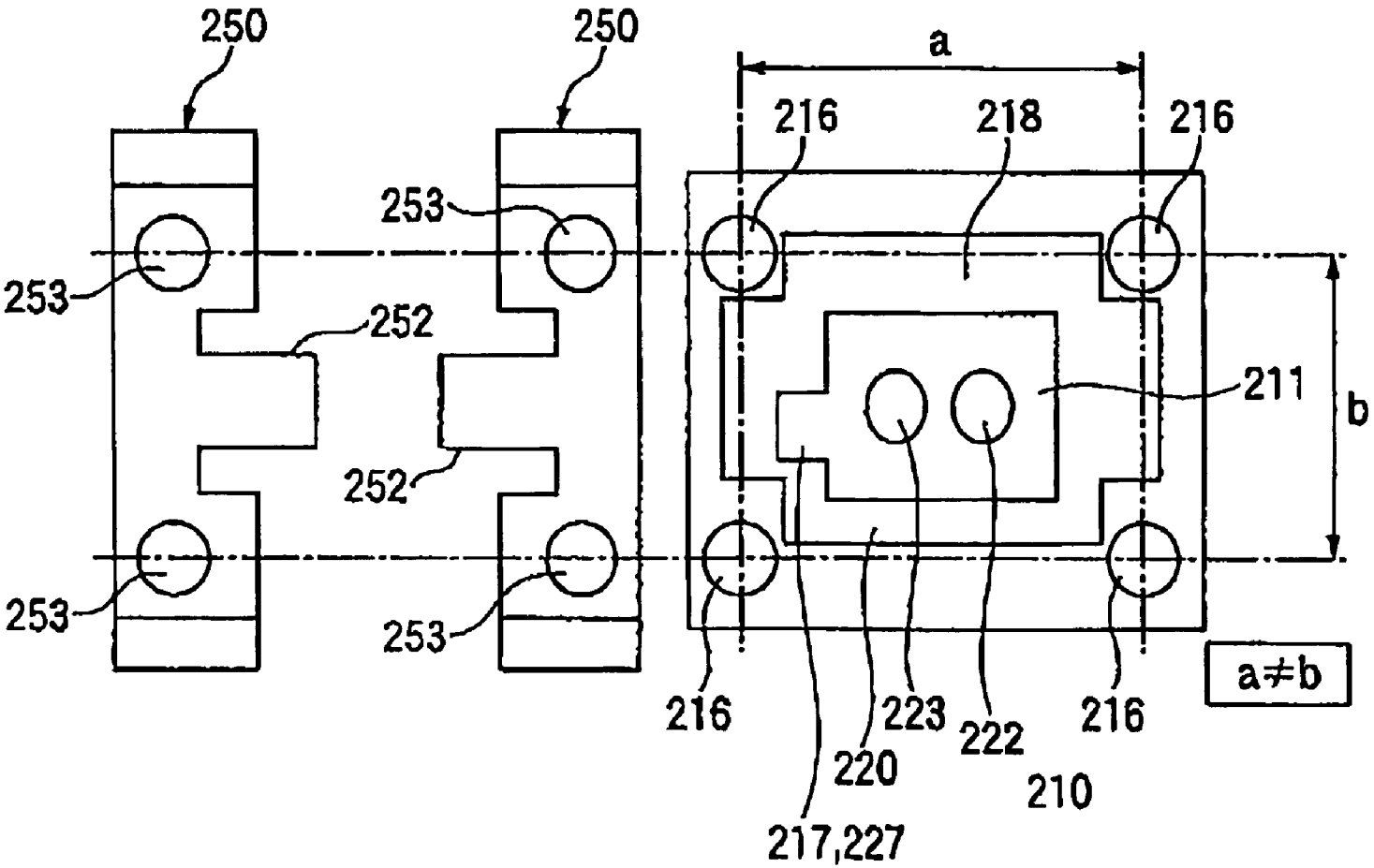
Figure 11:
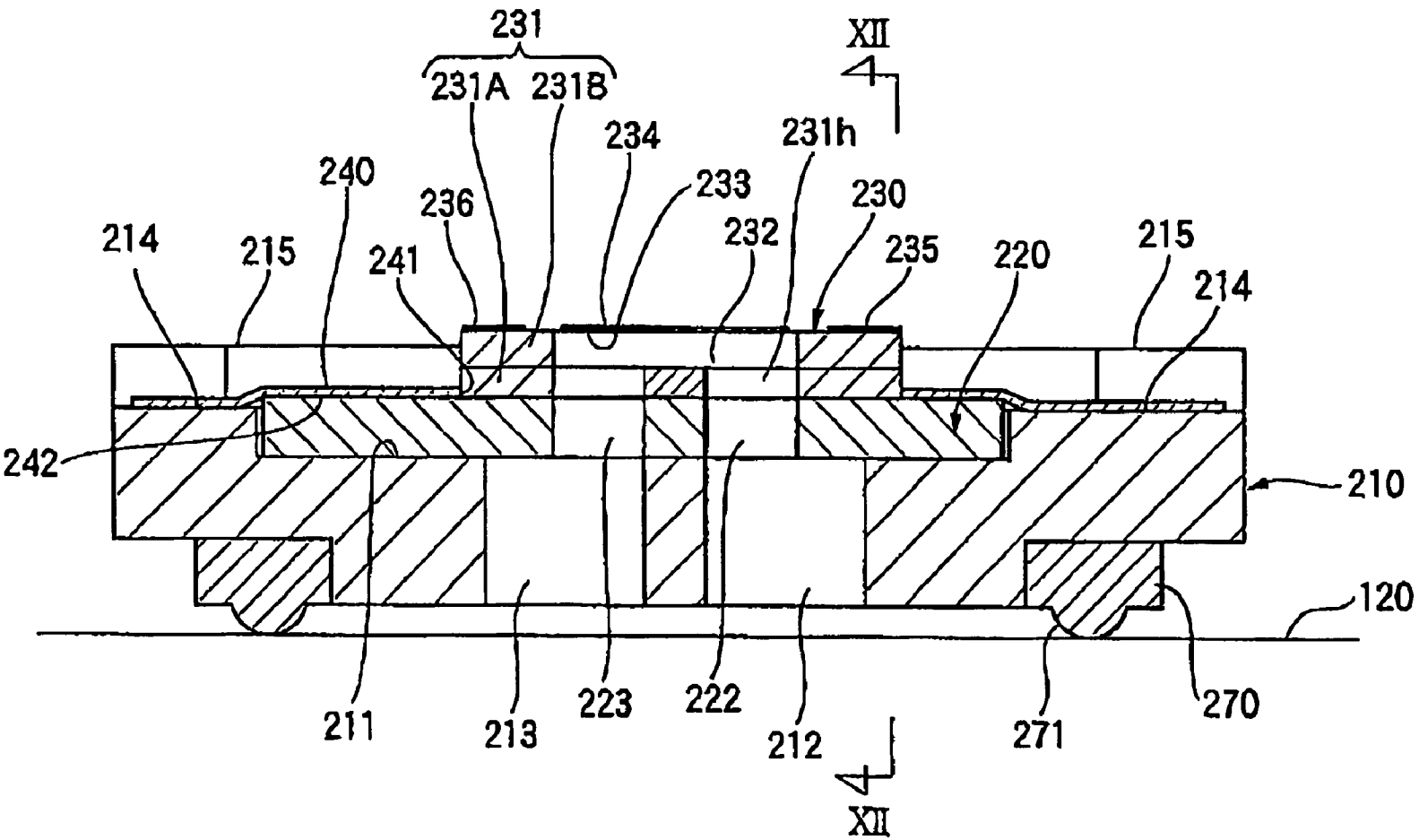
FIG. 11 is a cross-sectional view of main parts of the sensor unit.
Figure 12:
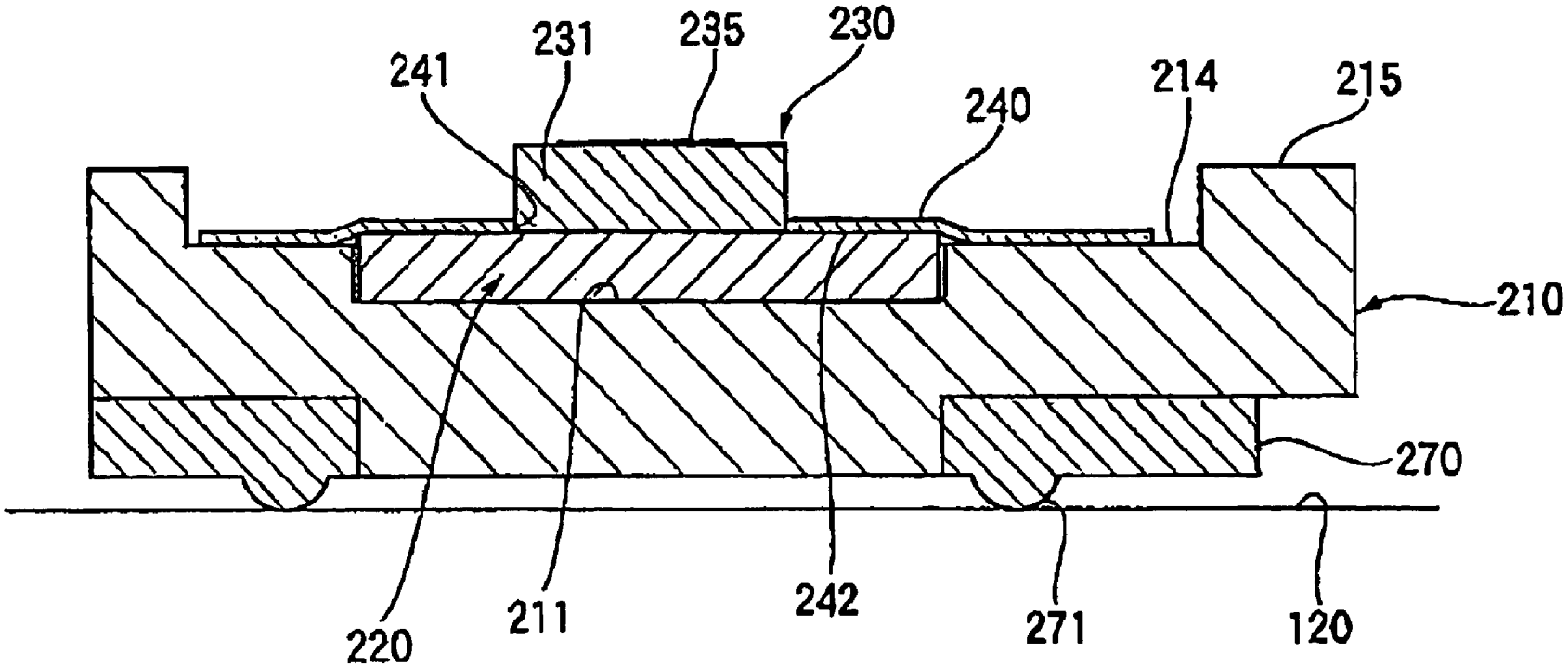
FIG. 12 is a cross-sectional view taken along line XII-XII of FIG. 11.

FIG. 3 is an exploded perspective view showing configurations of the sensor unit 200, the spring 300, the sealing cover 400, and the board 500. In addition, FIG. 4 is an exploded perspective view of the sensor unit 200, FIG. 5 is an exploded perspective view of the sensor unit 200 when viewed at an angle different from that of FIG. 4, FIG. 6 is a front view of a portion in which the sensor unit 200 and the spring 300 are assembled into the sensor receiving concave portion 110, FIG. 7 is a cross-sectional view taken along line VII-VII of FIG. 6, FIG. 8 is a cross-sectional view of the portion in which the sensor unit 200 and the spring 300 are assembled into the sensor receiving concave portion 110 when viewed at a front side, FIG. 9 is a horizontal cross-sectional view of that shown in FIG. 8, FIG. 10 is a plan view used for explaining a relationship between dimensions of main parts of the sensor unit, FIG. 11 is a cross-sectional view of main parts of the sensor unit 200, and FIG. 12 is a cross-sectional view taken along line XII-XII of FIG. 11.

Figure 7:
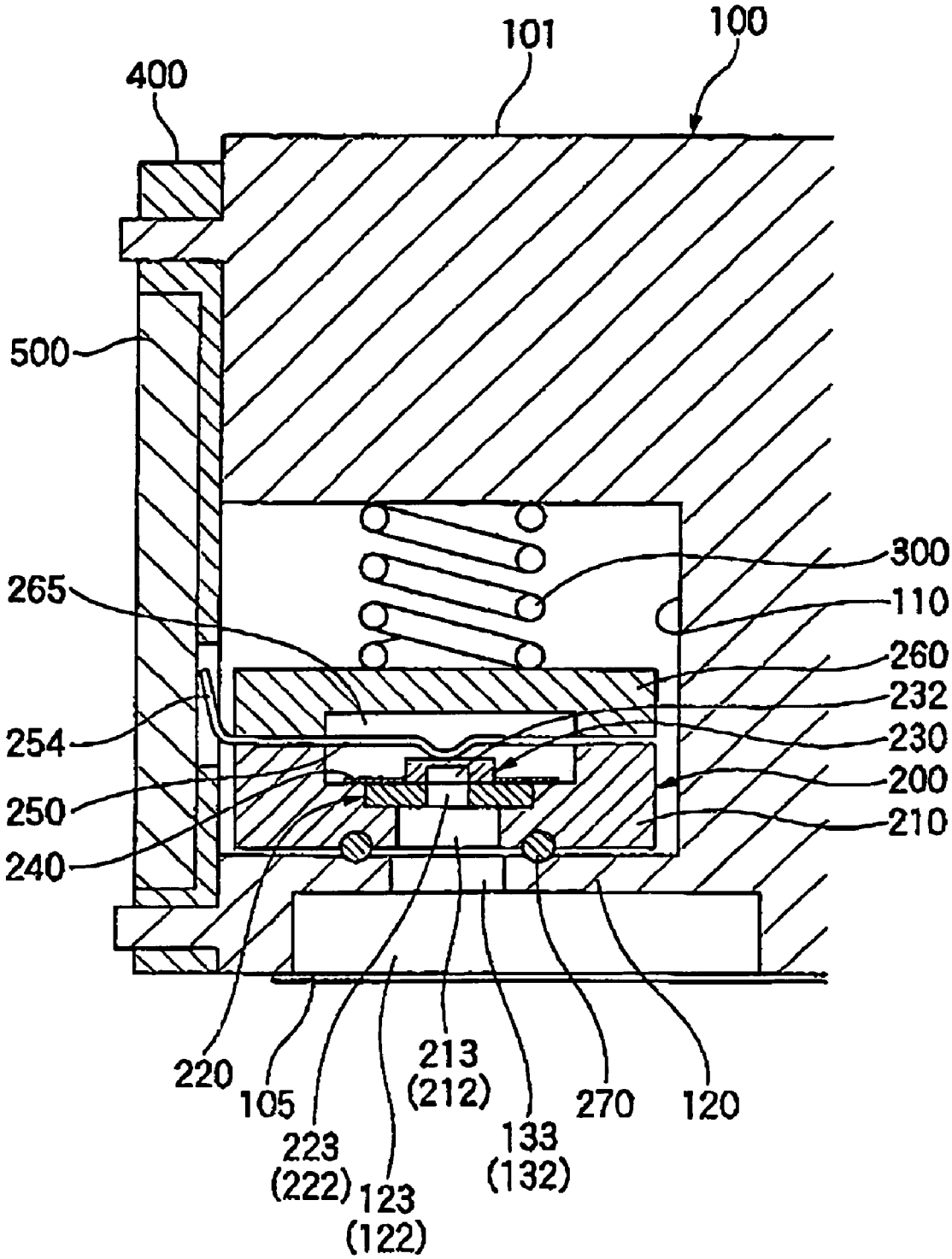
FIG. 7 is a cross-sectional view taken along line VII-VII of FIG. 6.
Figure 8:
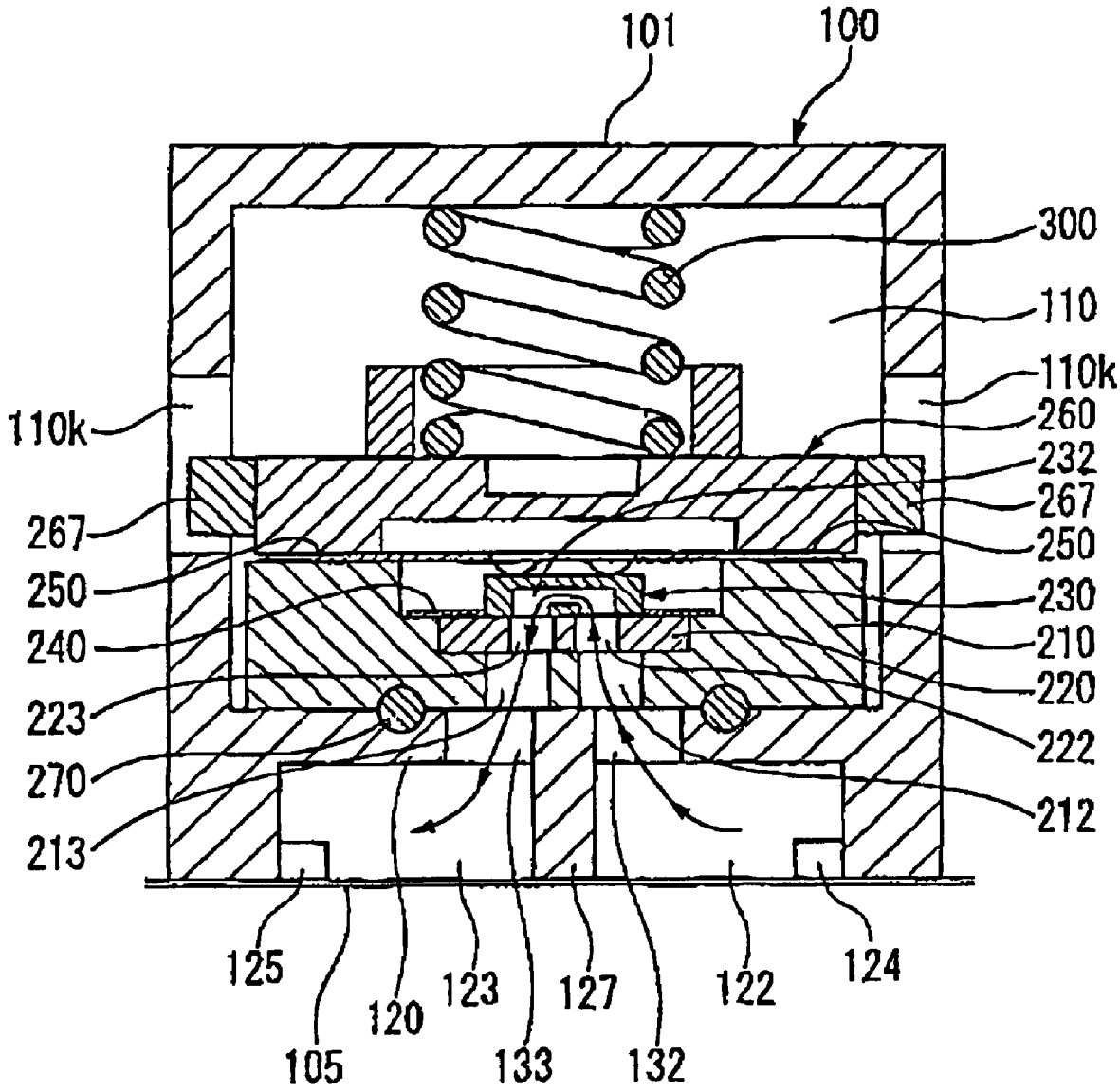
FIG. 8 is a cross-sectional view of the portion in which the sensor unit and the spring are assembled into the sensor receiving concave portion when viewed at a front side.

As shown in FIGS. 7 and 8, the sensor receiving wall 120 for receiving the lower end of the sensor unit 200 is provided at the inner bottom of the sensor receiving concave portion 110 of the cartridge case 101. On a flat upper surface of the sensor receiving wall 120, the sensor unit 120 is mounted, and a sealing ring (annular sealing member) 270 located at the lower end of the sensor unit 200 is closely in contact with the sensor receiving wall 120 by elasticity of the spring 300.

Upstream and downstream sensor buffer chambers 122 and 123 which are located at the right and left sides of a partition wall 127 (see FIG. 8) are provided at the lower side of the sensor receiving wall 120, and a pair of continuous holes (channels) 132 and 133 is provided in the sensor receiving wall 120 in correspondence with the sensor buffer chambers 122 and 123. Although not shown, a delivering channel (delivering passage) for delivering the accumulated ink to the outside is provided in the cartridge case 101. The sensor buffer chambers 122 and 123 and the sensor unit 200 are disposed in the vicinity of the end of the delivering channel (in the vicinity of the ink delivering port).

In this case, the upstream sensor buffer chamber 122 communicates with an upstream delivering passage through a communication orifice 124, and the downstream sensor buffer chamber 123 communicates with a downstream delivering passage close to the ink delivering port through a communication orifice 125. In addition, the lower surfaces of the sensor buffer chambers 122 and 123 are opened, not sealed by a rigid wall. The openings of the sensor buffer chambers 122 and 123 are covered by a sealing film 105 made of resin.

As shown in FIGS. 4 and 5, the sensor unit 200 includes: a plate-shaped unit base 210 made of resin and having a recess 211 at the upper surface thereof a plate-shaped sensor base 220 made of metal and received in the recess 211 of the upper surface of the unit base 210; a sensor chip 230 mounted and fixed on the upper surface of the sensor base 220; an adhesive film 240 for adhering the sensor base 220 to the unit base 210; a pair of terminal plates 250 having a same shape and disposed at an upper side of the unit base 210; a pressing cover 260 located on the terminal plate 250; and the sealing ring 270 made of rubber and disposed below the unit base 210.

Now, these parts will be described in detail. As shown in FIG. 5, the unit base 210 has the recess 211 into which the sensor base 220 is inserted at the center of the upper surface thereof. The unit base 210 also has a pair of mounting walls 215 protruded from an upper wall 214 at the outside of the upper wall 214 surrounding the recess 211. The mounting walls 215 face each other across the recess 211 and four support pins 216 are provided on the mounting walls 215 at four corners of the unit base 210.

In addition, as shown in FIG. 4, an entry side channel 212 and an exit side channel 213 formed of circular through-holes are formed in the bottom wall of the recess 211. These channels 212 and 213 serve as a liquid reserving space. Furthermore, an oblong convex portion 219 to which the sealing ring 270 is fitted is provided on the lower surface of the unit base 210. The entry-side channel 212 and the exit-side channel 213 pass through the convex portion 219. The sealing ring 270 is formed of a ring packing made of rubber and has an annular convex portion having a semi-circular cross section at the lower surface (see FIG. 11).

The sensor base 220 is formed of a metal plate such as stainless having rigidity higher than that of resin, for the purpose of improving acoustic characteristics of the sensor. The sensor base 220 has a rectangular plate shape of which four corners are chamfered and includes an entry-side channel 222 and an exit-side channel 223 formed of two through-holes and corresponding to the entry-side channel 212 and the exit-side channel 213 of the unit base 210. These channels 222 and 223 also serve as a liquid reserving space.

An adhesive layer 242 is formed on the upper surface of the sensor base 220, for example, by the adhesion of a double-sided adhesive film, coating of an adhesive, or the like, and the sensor chip 230 is mounted and fixed on the adhesive layer 242.

As shown in FIGS. 7, 8, and 11, the sensor chip 230 has a sensor cavity 232 which receives the ink (liquid) to be detected. The lower surface of the sensor cavity 232 is opened to allow the ink to be received and the upper surface thereof is closed by a diaphragm 233. A piezoelectric element 234 is disposed on the upper surface of the diaphragm 233.

As shown in FIGS. 11 and 12, the sensor chip 230 includes: a chip body 231 made of ceramic and having the sensor cavity 232, i.e. a circular opening, located at its center; the diaphragm 233 laminated on the upper surface of the chip body 231 and configuring the bottom wall of the sensor cavity 232; the piezoelectric element 234 laminated on the diaphragm 233, and electrodes 235 and 236 laminated on the chip body 231.

The chip body 231 of the sensor chip 230 has a two-layer structure including a first layer 231A of the sensor base 220 side and a second layer 231B of the diaphragm 233 side. Two circular holes 231*h* configuring portions of the upstream and downstream channels are provided in the first layer 231A. The sensor cavity 232 is formed in only the second layer 231B. In this case, the sensor cavity 232 of the second layer 231B has an elongate circular shape (oblong shape) so that the two holes 231*h* of the first layer 231A are located within the elongate circular shape. The holes 231*h* of the first layer 231A are formed to overlap with the entry-side channel 222 and the exit-side channel 223 of the sensor base 220.

Although not shown, the piezoelectric element 234 includes upper and lower electrode layers connected to the respective electrodes 235 and 236 and a piezoelectric layer laminated between the upper and lower electrode layers. The piezoelectric element 234 serves to determine an ink end by a characteristic difference according to existence of the ink in the sensor cavity 232. As the material of the piezoelectric layer, lead zirconate titanate (PZT), lead lanthanum zirconium titanate (PLZT), or a leadless piezoelectric film may be used.

The sensor chip 230 is integrally fixed to the sensor base 220 by the adhesive layer 242 by mounting the lower surface of the chip body 281 onto the center of the upper surface of the sensor base 220, and the sensor base 220 and the sensor chip 230 are sealed by the adhesive layer 242. In addition, the entry-side channels 222 and 212 and the exit-side channels 223 and 213 of the sensor base 220 and the unit base 210 communicate with the sensor cavity 232 of the sensor chip 230. By this configuration, the ink enters into the sensor cavity 232 through the entry-side channels 212 and 222 and discharged from the sensor cavity 232 through the exit-side channels 223 and 213.

The metal sensor base 220 on which the sensor chip 230 is mounted is received in the recess 211 of the upper surface of the unit base 210. In addition, the sensor base 220 and the unit base 210 are integrally adhered to each other by placing the adhesive film 240 made of resin over the sensor base 220 and the unit base 210 (see FIG. 11).

In other words, the adhesive film 240 has an opening 241 at the center thereof and covers the sensor base 220 in a state that the sensor base 220 is received in the recess 211 of the upper surface of the unit base 210 to expose the sensor chip 230 from the opening 241. In addition, the inner circumferential side of the adhesive film 240 is bonded to the upper surface of the sensor base 220 through the adhesive layer 242 and the outer circumferential side thereof is bonded to the upper wall 214 surrounding the recess 211 of the unit base 210, that is, the adhesive film 240 is adhered over the upper surfaces of two parts (the sensor base 220 and the unit base 210), such that the sensor base 220 and the unit base 210 are adhered to each other and sealed.

In this case, the upper surface of the sensor base 220 is protruded from the recess 211 of the unit base 210 upward and the adhesive film 240 is bonded to the upper surface of the sensor base 220 at a position higher than an adhesion position of the upper wall 214 surrounding the recess 211 of the unit base 210. The height of the film adhesion surface of the sensor base 220 is set to be higher than the height of the film adhesion surface of the unit base 210 such that the sensor base 220 can be pressed toward the unit base 210 by the adhesive film 240 using a step. Accordingly, the fixing of the sensor base 220 onto the unit base 210 can be reinforced, and the sensor base 220 can be mounted stably onto the unit base 210 without rattling.

In addition, as shown in FIGS. 4 and 5, each terminal plate 250 includes a band-shaped board portion 251, a spring piece 252 protruded from the side edge of the board portion 251, mounting holes 253 formed in the respective sides of the board portion 251, and bending pieces formed at respective sides of the board portion 251, and is disposed on the upper surfaces of the mounting walls 215 of the unit base 210 in a state that the support pins 216 are inserted into the mounting holes 253.

Furthermore, by mounting the pressing cover 260 on the terminal plates 250, the terminal plates 250 are interposed between the unit case 210 and the pressing cover 260, and, in this state, the spring pieces 252 are in contact with and electrically connected to the electrodes 235 and 236 of the upper surface of the sensor chip 230. The pressing cover 260 is a flat frame mounted on the upper surfaces of the mounting walls 215 of the unit base 210 through the terminal plates 250.

The pressing cover 260 includes a flat plate 261 mounted on the upper surfaces of the mounting walls 215 of the unit base 210 through the board portions 251 of the terminal plates 250, four mounting holes 262 which are disposed at four corners of the flat plate 261 and into which the support pins 216 of the unit base 210 are inserted, an upstanding wall 263 provided on the center of the upper surface of the flat plate 261, a spring receiving portion 264 provided in the wall 263, and concave portions 265 serving as relief portions which respectively permit the spring pieces 252 of the terminal plates 250 to be elastically deformed. The pressing cover 260 is mounted on the upper surface of the unit base 210 while pressing the terminal plates 250 downward. The pressing cover 260 protects the sensor plate 220 and the sensor chip 230 received in the recess 211 of the upper surface of the unit base 210.

In order to assemble the sensor unit 200 using the above-mentioned parts, first, the adhesive layer 242 is formed on the almost entire upper surface of the sensor base 220 and the sensor chip 230 is mounted on the adhesive layer 242, such that the sensor chip 230 and the sensor base 220 are integrally adhered to each other and sealed by the adhesive layer 242.

Next, the sensor base 220 which is integrally formed with the sensor chip 230 is received in the recess 211 of the upper surface of the unit base 210, and, in this state, the adhesive film 240 is mounted such that the inner circumferential side of the adhesive film 240 is bonded to the upper surface of the sensor base 220 through the adhesive layer 242 and the outer circumferential side thereof is bonded to the upper wall 214 surrounding the recess 211 of the unit base 210. Accordingly, the sensor base 220 and the unit base 210 are integrally adhered to each other and sealed by the adhesive film 240.

Next, the terminal plates 250 are disposed on the unit base 210 while inserting the support pins 216 of the unit base 210 into the mounting holes 253 and the pressing cover 260 is mounted thereon. In addition, in any step of assembly of the sensor unit 200, the sealing ring 270 can be fitted to the convex portion 219 of the lower surface of the unit base 210. Accordingly, it is possible to assemble the sensor unit 200.

The sensor unit 200 is configured as described above and is received in the sensor receiving concave portion 110 of the cartridge case 100 together with the compressed spring 300. In this state, the spring 300 presses the pressing cover 260 downward such that the sealing ring 270 provided on the lower surface of the unit base 210 is deformed and comes into contact with the sensor receiving wall 120 in the sensor receiving concave portion 110. Thus, it is possible to ensure the sealing property between the sensor unit 200 and the cartridge case 101.

By the above-mentioned assembly, the upstream buffer chamber 122 in the cartridge case 101 communicates with the entry-side channels 212 and 222 in the sensor unit 200 through a communication hole (connection channel) 132 of the sensor receiving wall 120 and the downstream buffer chamber 123 in the cartridge case 101 communicates with the exit-side channels 213 and 223 in the sensor unit 200 through a communication hole (connection channel) 133 of the sensor receiving wall 120 under the condition that the sealing property is ensured. In addition, the entry-side channels 212 and 222, the sensor cavity 232, the exit-side channels 223 and 213 are disposed in the delivering channel of the cartridge case 101 and arranged in series in that order from the upstream side in.

Here, the upstream channel connected to the sensor cavity 232 includes the upstream buffer chamber 122 having a large channel cross section, the communication hole 132, and the entry-side channels 212 and 222 having a small channel cross section in the sensor unit 200 (upstream narrow channel). The downstream channel connected to the sensor cavity 232 includes the downstream buffer chamber 123 having a large channel cross section, the communication hole 133, and the exit-side channels 213 and 223 having a small channel cross section in the sensor unit 200 (downstream narrow channel).

Accordingly, the ink flowing out of the upstream side of the delivering passage flows into the upstream buffer chamber 122 through an introduction hole 124, and enters into the sensor cavity 232 through the upstream communication path (the communication hole 132 and the entry-side channels 212 and 222). Then, the ink is delivered from the sensor cavity 232 to the downstream communication path (the exit-side channels 223 and 213) and the downstream buffer chamber 123 and is discharged to the downstream side of the delivering passage through a lead-out hole 125.

Among the channels connected to the sensor cavity 232, the communication path (the communication holes 132 and 183, the entry-side channels 212 and 222, and the exit-side channels 213 and 223) has a small channel cross section smaller than that of the buffer chambers 122 and 123.

In addition, as shown in FIG. 3, the sealing cover 400 for closing the side opening of the sensor receiving concave portion 110 includes: a concave portion 402 which is provided in the outer surface of a plate-shaped cover body 401 and to which the circuit board 500 is fitted; two opening 403 passing through the bottom wall of the concave portion 402 for exposing the bending pieces 254 of the terminal plates 250; pins 406 and 407 for positioning the circuit board 500; and engagement hooks 405 which are protruded from the inner surface of the cover body 401 to be engaged with predetermined respective portions of the sensor receiving concave portion 110. The sealing cover 400 is attached to the cartridge case 101 in a state that the sensor unit 200 and the spring 300 are received in the sensor receiving concave portion 110. By attaching the board 500 to the concave portion 402 of the sealing cover 400 in this state, the terminal plates 250 can be electrically connected to predetermined contacts 501 of the board 500. In addition, the board 500 has a notch 506 and a hole 507 for engagement with the positioning pins 406 and 407.

Next, mis-assembly preventing structures provided between the sensor unit 200 and the cartridge case 101, between the sensor base 220 and the unit base 210, between the unit base 210 and the terminal plate 250, and between the unit base 210 and the pressing cover 260 will be described.

The mis-assembly preventing structure allows the assembly only when the parts are assembled in an adequate direction and does not allow the assembly by interference between the parts when the parts are assembled in an inadequate direction.

First, the mis-assembly preventing structure provided to the sensor unit 200 and the cartridge case 101 will be discussed. The mis-assembly preventing structure is configured to allow insertion when the sensor unit 200 is inserted into the sensor receiving concave portion 110 of the cartridge case 101 in an adequate direction and not to allow the insertion by interference between the sensor unit 200 and the cartridge case 101 when the sensor unit 200 is inserted into the sensor receiving concave portion 110 of the cartridge case 101 in an inadequate direction (180° reverse direction). As shown in FIG. 9, as the mis-assembly preventing stricture, engagement hooks 267 are provided at the both side surfaces of the pressing cover 260 and engagement concave portions 110*k* are provided at the both side walls of the sensor receiving concave portion 110.

In other words, the engagement hooks 267 are protruded from the left and right side surfaces of the pressing cover 260 (configuring a part of the sensor unit 200) as viewed in an insertion direction of the pressing cover 260 into the sensor receiving concave portion 110. When the sensor unit 200 is inserted into the sensor receiving concave portion 110 in the adequate direction, the sensor unit 200 can advances into the sensor receiving concave portion 110 while outwardly deforming the both side walls of the sensor receiving concave portion 110 by inclined walls 267*a*. In contrast, when the sensor unit 200 is inserted into the sensor receiving concave portion 110 in the inadequate direction, edge walls 267*b*, which are located opposite from the inclined walls 267*a*, collide with the periphery of an inlet of the sensor receiving concave portion 110 such that the sensor unit 200 is prevented from being inserted. In addition, the engagement concave portions 110*k* are provided in the both side walls of the sensor receiving concave portion 110. When the sensor unit 200 is inserted up to a predetermined location of the sensor receiving concave portion 110, the engagement concave portions 110*k* receive the engagement hooks 267 while excessive interference is avoid (that is, without strong collision).

In the case in which the engagement hooks 267 are provided to the sensor unit 200 and the engagement concave portions 110*k* are provided to the cartridge case 101, the insertion of the sensor unit 200 into the sensor receiving concave portion 110 in the inadequate direction can be inhibited because the edge walls 267*b* of the engagement hooks 267 collide with the periphery of the inlet of the sensor receiving concave portion 110. In contrast, the insertion of the sensor unit 200 into the sensor receiving concave portion 110 in the adequate direction is permitted because the sensor unit 200 can advance into the sensor receiving portion 110 inward while the engagement hooks 267 induce deformation of the both side walls of the sensor receiving concave portion 110 outward by the inclined walls 267*a*. In addition, when the sensor unit 200 is inserted up to the predetermined location of the sensor receiving concave portion 110 in the adequate direction, the engagement hooks 267 are received in the engagement concave portions 110*k* while the excessive interference is avoid. In other wards, the engagement hooks 267 can be moved relative to the engagement concave portions 110*k* in some degrees in the insertion direction and in directions perpendicular to the insertion direction while maintaining the engagement between the engagement hooks 267 and the engagement concave portion 110K.

Accordingly, it is possible to previously prevent the sensor unit 200 from being wrongly assembled in the sensor receiving concave portion in a 180° reverse direction. In this case, since the engagement hooks 267 are provided at the left and right side surfaces of the sensor unit 200 and the engagement concave portions 110*k* are provided in the left and right side walls of the sensor receiving concave portion 110, even when an ink accumulating space exists at the opposite side of the rear wall of the sensor receiving concave portion 110, it is possible to prevent the mis-assembly without sacrificing the liquid accumulating space, that is, without affecting the ink accumulating space.

In addition, as another example of the mis-assembly preventing structure, an engagement protrusion may be provided at a rear end of the insertion direction of the sensor unit 200 and an engagement concave portion for receiving the engagement protrusion may be provided in a rear wall of the sensor receiving concave portion 110. In this case, when the sensor unit 200 is inserted in the reverse direction, since the engagement protrusion is disposed at a front side, the sealing cover 400 is not normally closed and thus it can be determined that the insertion direction is wrong. However, when the engagement concave portion is provided in the rear wall of the sensor receiving concave portion 110, the volume of the ink accumulating portion which exists at the opposite side surface of the rear wall may be unpreferably reduced.

In contrast, an engagement protrusion may be provided at the sensor receiving concave portion 110 and an engagement concave portion for receiving the engagement protrusion may be provided in the sensor unit 200. However, in this case, since a space of the sensor unit 200 is insufficient, it is difficult to realize this structure.

Accordingly, since the engagement hooks 267 are protruded from the both side surfaces of the sensor unit 200 and the engagement concave portions 110*k* for receiving the engagement hooks 267 are provided at the both side walls of the sensor receiving concave portion 110, the present embodiment is advantageous in that the engagement concave portions 110*k* does not reduce the volume of the ink accumulating portion.

In addition, when adequate assembly is performed, the engagement concave portions 110*k* are engaged with the engagement hooks 267 while the excessive interference is avoid. Accordingly, the deformed state of the sealing ring 270 due to the pressing spring 300 is not affected and the oscillation characteristics of the sensor unit 200 are not affected.

As a method of performing the engagement while the excessive interference is avoid, the engagement concave portions 110*k* may be sufficiently large in consideration of the deformation height of the sealing ring 270. Alternatively, when the sensor unit 200 is assembled, the engagement concave portions 110*k* may be widely formed up to a location higher than a location of the engagement hooks 267 which are finally received such that the sealing ring 270 and the sensor receiving wall 120 does not excessively interfere with each other.

Figure 13:
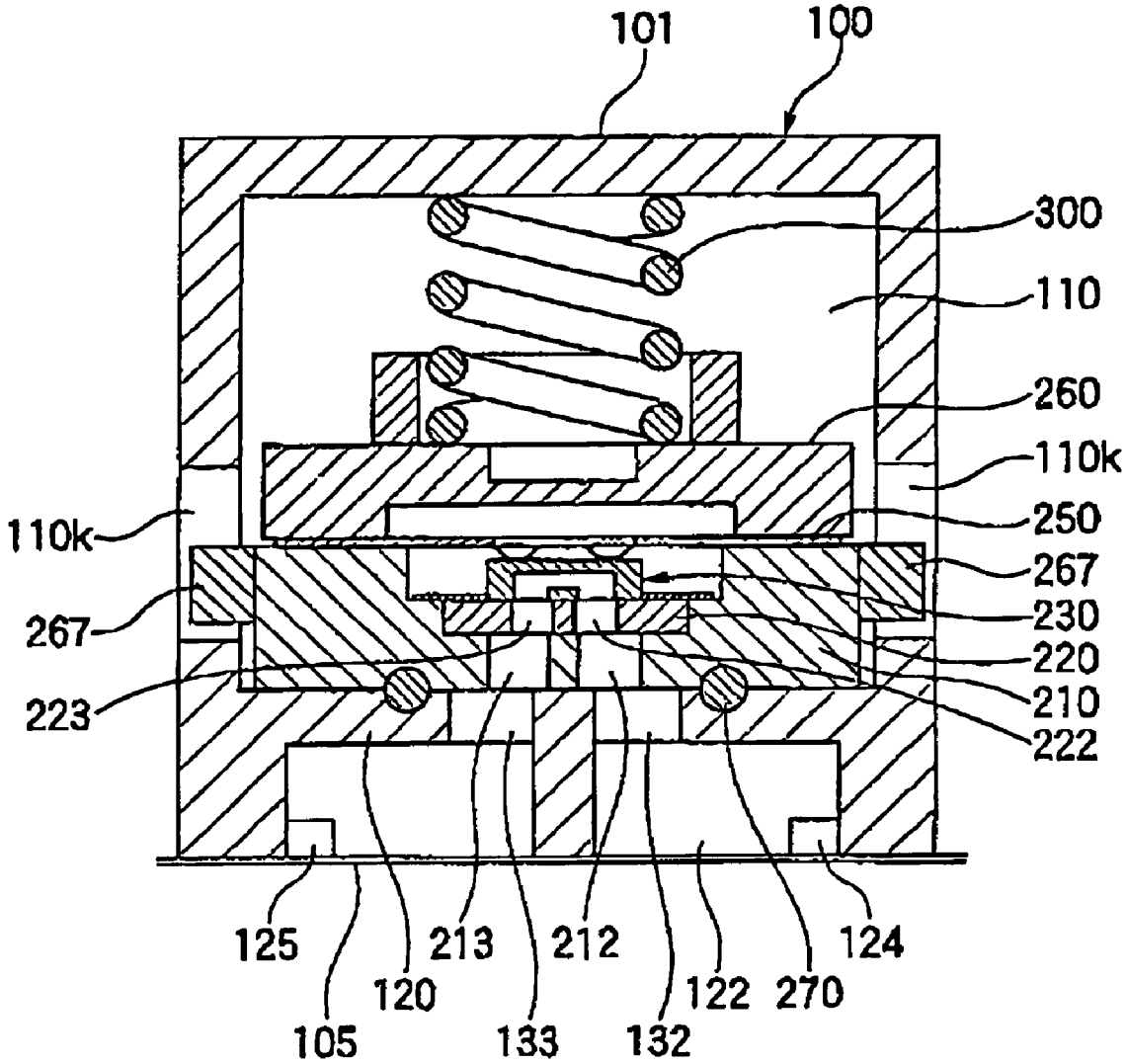
FIG. 13 is a cross-sectional view of a modified example of the presents invention.

Like an embodiment of FIG. 13, even when the engagement hooks 267 are protruded from the both side surfaces of the unit base 210, not the pressing cover 260, it is possible to prevent the mis-assembly of the sensor unit 200.

Next, the mis-assembly preventing structure provided between the sensor base 220 and the unit base 210 will be described with reference to FIGS. 5 and 10. This mis-assembly preventing structure allows insertion when the sensor base 220 is inserted into the recess 211 of the upper surface of the unit base 210 in an adequate direction and does not allows the insertion by the interference between the sensor base 220 and the unit base 210 when the sensor base 220 is inserted into the recess 211 in an inadequate direction.

The mis-assembly preventing structure includes a positioning convex portion 227 which is protruded from the periphery of the sensor base 220 and prevents the sensor base 220 from being inserted into the recess 211 by the interference with the periphery of the recess 211 of the unit base 210 when the sensor base 220 is inserted into the recess 211 of the upper surface of the unit base 210 in the inadequate direction, and a positioning concave portion 217 which is provided in the periphery of the recess 211 of the unit base 210 and receives the positioning convex portion 27 of the sensor base 220 when the sensor base 220 is inserted into the recess 211 of the upper surface of the unit base 210 in the adequate direction.

In the case in which the positioning convex portion 227 is provided to the sensor base 220 and the positioning concave portion 217 is provided to the unit base 210, the insertion of the sensor base 220 into the recess 211 of the unit base 210 in the inadequate direction is inhibited because the positioning convex portion 227 interferes with the periphery of the recess 211 of the unit base 210. In contrast, the insertion of the sensor base 220 into the recess 211 of the unit base 210 in the adequate direction is permitted because the positioning convex portion 227 is received in the positioning concave portion 217. Accordingly, the unit base 210 is not fixed to the sensor base 220 in a wrong direction.

Next, the mis-assembly preventing structure which is provided between the unit base 210 and the terminal plates 250 will be described with reference to FIG. 10. The mis-assembly preventing structure includes the support pins 216 of the unit base 210 and the mounting holes 253 of the terminal plates 250, allows the assembly when the terminal plates 250 are assembled in the upper surface of the unit base 210 in an adequate direction, and prevents the assembly by the interference between the support pins 216 of the unit base 210 and the terminal plates 250 when the terminal plates 250 are assembled in the upper surface of the unit base 210 in an inadequate direction.

As the terminal plate 250, as described above, a pair of terminal plates 250 having the same shape and including two mounting holes 253 is used. On the upper surface of the unit base 210, four support pins 216 which are inserted into the mounting holes 253 of the terminal plates 250 are protruded at virtual rectangular vertexes.

In this case, an interval between the support pins which are vertically arranged at the virtual rectangular vertexes is equal to an interval b between the two mounting holes 253 of the terminal plate 250 and an interval between the support pins which are horizontally arranged is set to a value a different from the interval b between the two mounting holes 253 of the terminal plate 250.

By the above described configuration, the following effect can be obtained.

For example, when the intervals between adjacent two support pins 216 among the four support pins 216 are the same in both a vertical direction and a horizontal direction, the terminal plate 250 may be rotated by 90° and may be mounted in this orientation. In contrast, as described above, when the interval between the vertically adjacent support pins 216 and the interval between the horizontally adjacent support pins 216 are different from each other and only the interval between the vertically adjacent support pins 216 is equal to the interval b between the mounting holes 253 of the terminal plate 250, only the two support pins 216 which are vertically arranged can be fitted to the two mounting holes 253 of the terminal plate 250. In other words, the terminal plate 250 can be attached to the support pins 216 which are vertically arranged, but cannot be attached to the support pins 216 which are horizontally arranged. Accordingly, it is possible to prevent the error in the mounting direction.

Next, the mis-assembly preventing structure provided between the unit base 210 and the pressing cover 260 will be described with reference to FIGS. 4, 5, and 10. The mis-assembly preventing structure allows the assembly when the pressing cover 260 is assembled in the unit base 210 in an adequate direction and does not allow the assembly by the interference between the pressing cover 260 and the unit base 210 when the pressing cover 260 is assembled in the unit base 210 in an inadequate direction.

The mis-assembly preventing structure includes a positioning protrusion 268 which is protruded from the lower surface of the pressing cover 260 and prevents the pressing cover 260 from being assembled on the upper surface of the unit base 210 by interference with the periphery of the recess 211 of the unit base 210 when the pressing cover 260 is assembled in the upper surface of the unit base 210 in the inadequate direction and a positioning concave portion 218 which is provided in the periphery of the recess 211 of the unit base 210 and receives the positioning protrusion 268 of the lower surface of the pressing cover 260 when the pressing cover 260 is assembled in the upper surface of the unit base 210 in the adequate direction.

When the positioning protrusion 268 is provided on the lower surface of the pressing cover 260 and the positioning concave portion 218 is provided in the unit base 210, the assembly of the pressing cover 260 on to the unit base 210 in the inadequate direction (180° reverse direction) is inhibited because the positioning protrusion 268 interferes with the periphery of the recess 211 of the unit base 210. In contrast, the assembly of the pressing cover 260 onto the unit base 210 in the adequate direction is permitted because the positioning protrusion 268 is received in the positioning concave portion 218. Accordingly, the pressing cover 260 is not fixed to the unit base 210 in a wrong direction.

Now, a principle of detecting the ink using the sensor unit 200 will be described.

When ink is consumed by the recording head, ink accumulated in the ink cartridge 101 passes through the sensor cavity 232 of the sensor unit 200 and is sent from the ink delivering portion 103 to the recording head 12 of the inkjet recording device.

At this time, when the ink sufficiently remains in the ink cartridge 100, the ink is filled in the sensor cavity 232. In contrast, when the residual quantity of the ink cartridge 100 is reduced, the ink is not filled in the sensor cavity 232.

Accordingly, the sensor unit 200 detects a difference between acoustic impedances due to the state change and thus can detect whether the ink sufficiently remains or whether a predetermined quantity of ink has been consumed and thus the residual quantity is small.

When a voltage is applied to the piezoelectric element 234, the diaphragm 233 is deformed depending on the deformation of the piezoelectric element 234. When the piezoelectric element 234 is forcibly deformed and the application of the voltage is then released, flexural oscillation remains in the diaphragm 233 for a while, The residual oscillation is free oscillation between the diaphragm 233 and the medium in the cavity 232. Accordingly, when a pulse-shaped or rectangular voltage is applied to the piezoelectric element 234, it is possible to easily obtain a resonance state between the diaphragm 233 and the medium after the voltage is applied.

The residual oscillation is the oscillation of the diaphragm 233 and deforms the piezoelectric element 234. Accordingly, the piezoelectric element 7 generates a back electromotive force with the residual oscillation. The back electromotive force is detected through the terminal plate 250 by an external device.

Since a resonance frequency is specified by the detected back electromotive force, it is possible to detect whether or not the ink is filled in the ink cartridge 100 depending on the resonance frequency.

According to the above described embodiment since the sealing ring 270 having elasticity is interposed between the sensor unit 200 and the sensor receiving wall 120 and the sensor unit 200 is pressed against the sensor receiving wall 120 by the spring 300 such that the sensor unit 200 and the sensor receiving wall 120 are sealed while deforming the sealing ring 270 (the sealing ring 270 may be at least in part deformed plastically), an assembling procedure of assembling the sensor unit 200 in advance and mounting the sensor unit 200 in the cartridge case 101 later may be employed. In addition, it is possible to more simply perform the assembly, compared with a case of using the adhesive.

Furthermore, since the dimensional variation between the sensor unit 200 and the sensor receiving wall 120 can be absorbed by the elasticity of the sealing ring 270, it is possible to surely perform the sealing by simple assembly. In addition, since the liquid reserving space (the entry-side channels 212 and 222 and the exit-side channels 213 and 223) sealed by the sealing ring 270 is formed at the front side (the opened side) of the sensor cavity 232, the sensor unit is protected from an adverse influence caused by the fluctuation of the ink or entry of the air bubble in the ink.

Moreover, when the pressing cover 260 for protecting the sensor chip 230 is provided above the sensor chip 230 and the load of the pressing spring 300 acts on the unit base 210 through the pressing cover 260, it is possible to easily obtain necessary sealing performance and oscillation performance without affecting the sensor chip 230.

In addition, since the mis-assembly preventing structures are provided between the sensor unit 200 and the cartridge case 101, between the sensor base 220 and the unit base 210, between the unit base 210 and the terminal plate 250, and between the unit base 210 and the pressing cover 260, it is possible to properly assemble those parts without a complicated check process. Thus, it is possible to improve yield and productivity.

Moreover, since the spring 300 is simply received in the sensor receiving portion 110 while being compressed, the spring 300 can be easily assembled together with the sensor unit 200.

In addition, the sensor base 220 on which the sensor chip 230 is mounted is assembled on the unit base 210 and then the adhesive film 240 is adhered over the adjacent upper surfaces of two parts, that is, the adjacent upper surfaces of the sensor base 220 and the unit base 210, thereby performing fixing and sealing between the two parts made of different materials (the sensor base 220 made of metal and the unit base 210 made of resin) concurrently. Accordingly, the assembly workability is significantly improved. In addition, since the adhesive film 240 is simply adhered over the two parts, it is possible to perform the sealing between the parts, without being influenced by the dimensional precision of the parts. Furthermore, for example, when the adhesive film 240 is adhered under heat and pressure using a mass production machine, it is possible to simply control the temperature and the pressure by the mass production machine to thereby increase sealing performance. Accordingly, it is possible to obtain stability in mass production. Moreover, since the adhesive film 240 influencing the sealing property can be easily mounted and has excellent space efficiency, it is possible to miniaturize the sensor unit 200.

Moreover, since the entry-side channels 212 and 222 and the exit-side channels 213 and 223 for the sensor cavity 232 are provided in the unit base 210 and the sensor base 220, and the ink flows into the sensor cavity 232 through the entry-side channels 212 and 222 and flows out through the exit-side channels 213 and 223, the ink consistently flows in the sensor cavity 232. Accordingly, it is possible to prevent false detection due to the liquid or the air bubble staying in the sensor cavity 232.

In adhesion, since the height of the adhesion surface of the adhesive film 240 on the unit base 210 is lower than that of the adhesion surface of the adhesive film 240 on the sensor base 220, it is possible to press the sensor base 220 with the adhesive film 240 using the step and to increase a fixing force between the sensor base 220 and the unit base 210. Moreover, it is possible to realize stable fixing without rattling.

Moreover, since the sensor unit 200 is provided in the vicinity of an end of the delivering channel of the cartridge case 101 and the entry-side channels 212 and 222, the sensor cavity 232, the exit-side channels 223 and 213 of the sensor unit 200 are arranged in the delivering channel and disposed in series in that order from the upstream side, it is possible to accurately detect residual quantity of the liquid in the ink cartridge 100.

What is claimed is:

1. A container comprising:

a container body accumulating liquid therein and having a delivering passage for delivering the liquid to an outside of the container body;

a sensor receiving portion provided in the container body in the vicinity of an end of the delivering passage;

a sensor unit, which is mounted in the sensor receiving portion, for detecting the liquid;

buffer chambers which are provided in the container body, situate close to the sensor receiving portion through a sensor receiving wall, communicate with an upstream side and a downstream side of the delivering passage, and are disposed in the delivering passage in series;

a sealing member which seals the sensor unit and the sensor receiving wall and has elasticity; and a pressing spring which presses the sensor unit against the sensor receiving wall to apply a pressing force required for sealing the sensor unit and the sensor receiving wall to the sealing member, while deforming the sealing member, wherein the sensor unit comprises:

a sensor chip which has a sensor cavity for receiving the liquid to be detected, a lower surface of the sensor cavity being opened to receive the liquid and an upper surface thereof being closed by a diaphragm, and a piezoelectric element being provided on an upper surface of the diaphragm;

a sensor base which is made of metal and on which the sensor chip is mounted and fixed;

a unit base having an upper surface and a lower surface, the upper surface having a recess in which the sensor base is mounted, and the lower surface of the unit base facing the sensor receiving wall when the sensor unit is mounted in the sensor receiving portion;

a pressing cover which is mounted and fixed on the unit base to cover the sensor chip, receives the pressing force of the pressing spring, and delivers the pressing force to the unit base; and a pair of terminal plates which is mounted and fixed on the unit base and electrically connected to a pair of electrodes of the sensor chip, wherein a liquid reserving space communicating with the sensor cavity is formed in the unit base, a channel which connects the liquid reserving space with the buffer chambers is provided in the sensor receiving wall, and a mis-assembly preventing structure which allows assembly when parts are assembled in an adequate direction and prevents the assembly by interference between the parts when the parts are assembled in an inadequate direction are provided to at least a set of parts among sets of the sensor unit and the container body, the sensor base and the unit base, the unit base and the terminal plates, and the unit base and the pressing cover.

2. The container according to claim 1, wherein the mis-assembly preventing structure is provided to the sensor unit and the container body, which allows insertion when the sensor unit is inserted into the sensor receiving portion of the container body in an adequate direction and prevents the insertion when the sensor unit is inserted into the sensor receiving portion of the container body in an inadequate direction.

3. The container according to claim 2, wherein the mis-assembly preventing structure includes:

engagement hooks which are protruded from insertion direction side surfaces of the sensor unit to be inserted into the sensor receiving portion, advance into a rear side of the sensor receiving portion while outwardly deforming side walls of the sensor receiving portion by inclined walls when the sensor unit is inserted into the sensor receiving portion in the adequate direction, and prevent the insertion of the sensor unit by collision of edge walls at the opposite side of the inclined walls with a periphery of an inlet of the sensor receiving portion when the sensor unit is inserted into the sensor receiving portion in the inadequate direction; and engagement concave portions which are provided at the side walls of the sensor receiving portion and receive the engagement hooks while excessive interference is avoid when the sensor unit is inserted up to a predetermined location of the sensor receiving portion in the adequate direction.

4. The container according to claim 3, wherein the engagement hooks are protruded from side surfaces of the pressing cover or the unit base.

5. The container according to claim 1, wherein the mis-assembly preventing structure is provided to the sensor base and the unit base, which allows insertion when the sensor base is inserted into the recess of the upper surface of the unit base in the adequate direction and prevents the insertion by interference between the sensor base and the unit base when the sensor base is inserted into the recess of the upper surface of the unit base in the inadequate direction.

6. The container according to claim 5, wherein the mis-assembly preventing structure includes:

a positioning convex portion which is protruded from a periphery of the sensor base, and prevents the sensor base from being inserted into the recess by the interference with a periphery of the recess of the unit base when the sensor base is inserted into the recess of the upper surface of the unit base in the inadequate direction; and a positioning concave portion which is provided at the periphery of the recess of the unit base and receives the positioning convex portion when the sensor base is inserted into the recess of the upper surface of the unit base in the adequate direction.

7. The container according to claim 1, wherein the mis-assembly preventing structure is provided to the unit base and the terminal plates, which allows assembly when the terminal plates are assembled on the unit base in the adequate direction and prevents the assembly by interference between the terminal plates and the unit base when the terminal plates are assembled on the unit base in the inadequate direction.

8. The container according to claim 7, wherein the terminal plates have a same shape and each of the terminal plates has two mounting holes, wherein four support pins which are inserted into the mounting holes of the terminal plates are protruded at virtual rectangular vertexes on the unit base, wherein an interval between the support pins which are vertically arranged at the virtual rectangular vertexes is equal to an interval between two mounting holes of each of the terminal plates and an interval between the support pins which are horizontally arranged is different from the interval between the two mounting holes of each of the terminal plates, and wherein the mis-assembly preventing structure is configured by the support pins having different intervals in a vertical and horizontal direction and the mounting holes of the terminal plates.

9. The container according to claim 1, wherein the mis-assembly preventing structure is provided to the unit base and the pressing cover, which allows assembly when the pressing cover is assembled on the unit base in the adequate direction and prevents the assembly by the interference between the pressing cover and the unit base when the pressing cover is assembled on the unit base in the inadequate direction.

10. The container according to claim 9, wherein the mis-assembly preventing structure includes:

a positioning protrusion which is protruded from a lower surface of the pressing cover, and prevents the pressing cover from being assembled on the upper surface of the unit base by the interference with a periphery of the recess of the unit base when the pressing cover is assembled in the upper surface of the unit base in the inadequate direction; and a positioning concave portion which is provided at the periphery of the recess of the unit base and receives the positioning protrusion when the pressing cover is assembled on the upper surface of the unit base in the adequate direction.

11. A container comprising:

a container body accumulating liquid therein and having a delivering passage for delivering the liquid to an outside of the container body;

a sensor receiving portion provided in the container body;

a sensor unit, which is mounted in the sensor receiving portion, for detecting the liquid existing in a part of the delivering passage;

engagement hooks which are protruded from the sensor unit in opposite directions and which includes:

edge walls which collide with a periphery of an inlet of the sensor receiving portion to prevent insertion of the sensor unit when the sensor unit is inserted into the sensor receiving portion in an inadequate direction; and inclined walls which induce elastic deformation to enable the insertion of the sensor unit when the sensor unit is inserted into the sensor receiving portion in an adequate direction, and engagement concave portions which receive the engagement hooks when the sensor unit is inserted up to a predetermined location of the sensor receiving portion in the adequate direction.

12. A sensor unit comprising:

a sensor chip which has a sensor cavity for receiving liquid to be detected, a lower surface of the sensor cavity being opened to receive the liquid and an upper surface thereof being closed by a diaphragm, and a piezoelectric element being provided on an upper surface of the diaphragm;

a sensor base on which the sensor chip is mounted and fixed;

a unit base having an upper surface and a lower surface, the upper surface having a recess in which the sensor base is mounted;

a pressing cover which is mounted and fixed on the unit base to cover the sensor chip;

a pair of terminal plates which is mounted and fixed on the unit base and electrically connected to a pair of electrodes of the sensor chip;

a positioning convex portion which is protruded from a periphery of the sensor base, and prevents the sensor base from being inserted into the recess by the interference with a periphery of the recess of the unit base when the sensor base is inserted into the recess of the upper surface of the unit base in an inadequate direction; and a positioning concave portion which is provided at the periphery of the recess of the unit base and receives the positioning convex portion when the sensor base is inserted into the recess of the upper surface of the unit base in an adequate direction.

13. A sensor unit comprising:

a sensor chip which has a sensor cavity for receiving liquid to be detected, a lower surface of the sensor cavity being opened to receive the liquid and an upper surface thereof being closed by a diaphragm, and a piezoelectric element being provided on an upper surface of the diaphragm;

a sensor base on which the sensor chip is mounted and fixed;

a unit base having an upper surface and a lower surface, the sensor base being mounted on the upper surface;

a pressing cover which is mounted and fixed on the unit base to cover the sensor chip;

a pair of terminal plates which is mounted and fixed on the unit base and electrically connected to a pair of electrodes of the sensor chip;

two mounting holes formed in each of the terminal plates, an interval between the two mounting holes of one of the terminal plates being equal to an interval between the two mounting holes of the other of the terminal plate;

four support pins which are protruded at virtual rectangular vertexes on the unit base, and inserted into the mounting holes of the terminal plates;

wherein an interval between the support pins which are vertically arranged at the virtual rectangular vertexes is equal to the interval between the two mounting holes of each of the terminal plates and an interval between the support pins which are horizontally arranged is different from the interval between the two mounting holes of each of the terminal plates.

14. A sensor unit comprising:

a sensor chip which has a sensor cavity for receiving liquid to be detected, a lower surface of the sensor cavity being opened to receive the liquid and an upper surface thereof being closed by a diaphragm, and a piezoelectric element being provided on an upper surface of the diaphragm;

a sensor base on which the sensor chip is mounted and fixed;

a unit base having an upper surface and a lower surface, the upper surface having a recess in which the sensor base is mounted;

a pressing cover which is mounted and fixed on the unit base to cover the sensor chip;

a pair of terminal plates which is mounted and fixed on the unit base and electrically connected to a pair of electrodes of the sensor chip;

a positioning protrusion which is protruded from a lower surface of the pressing cover, and prevents the pressing cover from being assembled on the upper surface of the unit base by interference with a periphery of the recess of the unit base when the pressing cover is assembled in the upper surface of the unit base in an inadequate direction; and a positioning concave portion which is provided at the periphery of the recess of the unit base and receives the positioning protrusion when the pressing cover is assembled on the upper surface of the unit base in an adequate direction.

* * * * *